US006790294B1

(12) United States Patent
Ishida et al.

(10) Patent No.: US 6,790,294 B1
(45) Date of Patent: Sep. 14, 2004

(54) SPRING WITH EXCELLENT FATIGUE ENDURANCE PROPERTY AND SURFACE TREATMENT METHOD FOR PRODUCING THE SPRING

(75) Inventors: Masaaki Ishida, Kyoto (JP); Kazuhiro Uzumaki, Kyoto (JP); Yuji Isono, Kyoto (JP); Keiichiro Teratoko, Kyoto (JP); Yoshiro Yamada, Kyoto (JP); Hiroshi Suzuki, Kyoto (JP); Hironobu Sasada, Kyoto (JP)

(73) Assignee: Suncall Corporation, Kyoto (JP)

( * ) Notice: Subject to any disclaimer, the term of this patent is extended or adjusted under 35 U.S.C. 154(b) by 0 days.

(21) Appl. No.: 09/673,235

(22) PCT Filed: Aug. 23, 1999

(86) PCT No.: PCT/JP99/04539

§ 371 (c)(1),
(2), (4) Date: Dec. 1, 2000

(87) PCT Pub. No.: WO00/49186

PCT Pub. Date: Aug. 24, 2000

(30) Foreign Application Priority Data

Feb. 19, 1999 (JP) ..... 11-041865
May 7, 1999 (JP) ..... 11-127628

(51) Int. Cl.[7] ..... C23C 8/24
(52) U.S. Cl. ..... 148/212; 148/228; 29/90.7
(58) Field of Search ..... 148/212, 228; 29/90.7; 72/53

(56) References Cited

U.S. PATENT DOCUMENTS 5,665,179 A * 9/1997 Izawa et al. ..... 148/226
5,816,088 A * 10/1998 Yamada et al. ..... 72/53

FOREIGN PATENT DOCUMENTS

| | | | |
|---|---|---|---|
| JP | 61099625 A | | 5/1986 |
| JP | 63267164 A | | 11/1988 |
| JP | 02311268 A | | 12/1990 |
| JP | 06240303 A | | 8/1994 |
| JP | 07214216 | * | 8/1995 |
| JP | 8053711 | * | 2/1996 |

* cited by examiner

*Primary Examiner*—Sikyin Ip
(74) *Attorney, Agent, or Firm*—Arent Fox PLLC

(57) ABSTRACT

Hard metal particles having hardness which is lower than the hardness of a nitrided outermost layer of a spring and in the range of Hv 500 to 800 and a diameter of 500 to 900 μm are protected against the nitrided surface of the spring at a velocity of 40 to 90 m/sec to prevent generation of a microcrack in the surface layer and provide a compression residual stress comparatively deep inside the spring. Against the resultant spring surface, a number of fine metal particles having a mean diameter of all particles of 80 μm or less, a mean diameter of each particle in the range between 10 μm inclusive and less than 100 μm, a spherical or near spherical shape with no square portions, a specific gravity of 7.0 to 9.0, and hardness which falls in the range between Hv 600 and Hv 1100 inclusive and is equal to or less than the hardness of the outermost surface layer of the spring after nitriding, at a velocity of 50 to 190 m/sec., while controlling temperature to be low enough to cause work hardening but not to cause softening due to recovery/recrystallization, to provide a high compression residual stress in a near surface layer without generation of microcracks in the surface layer and thus obtain a valve spring and the like excellent in fatigue strength.

9 Claims, 6 Drawing Sheets

Surface compression residual stress
(Mean value of outermost surface layer to depth of 10 μm)

SPRING WITH EXCELLENT FATIGUE ENDURANCE PROPERTY AND SURFACE TREATMENT METHOD FOR PRODUCING THE SPRING

TECHNICAL FIELD

The present invention relates to a surface treatment method for enhancing the performance of valve springs for internal combustion engines, clutch springs for transmissions of automobiles and the like, high-strength thin-sheet springs, and the like by projection of hard fine metal particles, and a high-performance spring produced by this surface treatment method.

BACKGROUND ART

The following are found to be prior art related to the present invention.

1. Japanese Patent Publication for Opposition No. 2-17607 "Surface Thermo-mechanical Heat Treatment Method for Metal Product"

This technique relates to a surface thermo-mechanical heat treatment method in which 40 to 200 μm shots having a hardness equal to or higher than that of a product to be treated are injected at a velocity of 100 m/sec or more so as to raise the temperature near the surface of the product up to an A3 transformation point or higher.

This method is a process in which a material to be processed is austenitized by heating the surface layer of the work due to collision and promptly cooled down so as to cause metallographic transformation of the work. This is different from the present invention in the technical principles and contents.

2. Japanese Laid-Open Patent Publication No. 9-279229, "Surface Treatment Method of Steel Work"

The disclosed technique mainly includes allowing a number of hard metal particles having a diameter of 20 to 100 μm to collide against the surface of a steel work at a velocity of 80 m/sec or more while controlling the temperature rise limit of the work surface to be equal to or higher than 150° C. but lower than a recovery/recrystallization temperature.

This disclosure does not mention nitriding, and hardly defines the properties of the metal particles, e.g. the specific gravity and hardness thereof. Although the collision velocity is defined as 80 m/sec or more, where the optimal velocity exists is unclear. Only the velocity of 180 m/sec is presented in an example and recognized to be effective. However, whether or not this velocity is optimal is unclear.

3. Japanese Laid-Open Patent Publication No. 10-118930, "Shot Peening Method of Spring and Spring Product"

A 0.64% C—Si—Mn—Cr—Mo—V steel spring is nitrided, shot-peened with 0.5 to 1.0 mm dia. shots, and then peened with particles having a specific gravity of 12 to 16, a diameter of 0.05 to 0.2 mm, and a hardness of 1200 to 1600. As the result, a surface residual stress of $\sigma R=-1950$ Mpa and a fatigue limit of 700±620 MPa at $5\times10^7$ times of repetition were obtained. This fatigue limit stress does not reach the level of the fatigue strength specified in the 8th embodiment of the present invention.

The objects and method of this disclosure are partly similar to those of the present invention, but different in that while this disclosure uses manufacturer-specific high-hardness and expensive cemented carbide particles having a size of 0.05 to 0.2 mm and a specific gravity of 12 to 16, the present invention uses more inexpensive and more available metal particles such as iron-based particles having a diameter of 0.01 to 0.08 mm. The resultant fatigue strength obtained in the present invention is superior to that obtained by this conventional method.

4. Japanese Patent Gazette No. 2613601 (Japanese Laid-Open Patent Publication No. 1-83644), "High-strength Spring"

This disclosure describes a spring containing 0.6 to 0.7% of C, 1.2 to 1.6% of Si, 0.5 to 0.8% of Mn, 0.5 to 0.8% of Cr, a total of 0.05 to 0.2% of one, two or more types selected from V, Mo, Nb, and Ta, and iron and impurities as the remainder, having nonmetallic inclusions with a maximum size of 15 μm, a surface roughness Rmax of 15 μm or less, and a maximum compression residual stress near the surface of 85 to 110 kgf/mm$^2$ (833 to 1079 MPa). This patent describes that, if the maximum compression residual stress near the surface exceeds 110 kgf/mm$^2$ (=1079 MPa), the production of the spring becomes difficult and the surface roughness of the spring degrades, unintentionally decreasing the fatigue strength. One of the inventors of this patent together with other researchers report in detail the performance of a spring produced according to the technique disclosed in this patent in the ESF (European spring Federation) sponsored spring technology international conference held in Düsseldorf, Germany on Apr. 3, 1990 after the filing of the application of this patent. According to the related article, titled "A High strength spring for Automotive Engine" by M. Abe, K. Saito, N. Takamura, and H. Yamamoto, the maximum compression residual stress of a spring which corresponds to the invention of the patent (Gazette No. 2613601) is about 950 MPa in the surface layer and about 820 MPa on the outermost surface as is seen from FIG. 9 of this article, and the surface roughness Rmax of the spring is 10.6 μm as is seen from Table 2 of this article. The fatigue limit of the spring is $\tau m=588$ MPa and $\tau a=\pm(450$ to $480)$ Mpa or so at $5\times10^7$ times of repetition as is seen from FIG. 11 of this article, which does not correspond to the 9 th and 10th embodiments of the present invention.

According to the present invention, the surface roughness will not increase even if the maximum compression residual stress in the surface layer exceeds 1079 MPa. Moreover, the residual stress is maximum on the outermost surface or closely near the surface, effectively preventing fatigue breaking from the surface. Accordingly, it is possible to obtain a spring satisfying the fatigue limit represented by equation or expression (2) in the 10th embodiment of the present invention without nitriding.

5. Japanese Laid-Open Patent Publication No. 5-339763, "Production Method of Coil Spring"

This disclosure describes that a spring product having a surface roughness Rmax of 5 μm or less and a fatigue strength of 60±57 kgf/mm$^2$ (588±559 MPa) at $5\times10^7$ times of stress repetition was obtained by descaling so as to suppress the surface roughness to a low level by shot peening, nitriding, and the following shot peening with 0.8 mm dia. cut wires. However, according to the data provided in an example of this disclosure obtained in the above manner, the fatigue strength does not satisfy expression (1) in the 8th embodiment of the present invention. Moreover, this document does not disclose projection of fine particles as disclosed in the present invention.

6. Japanese Laid-Open Patent Publication No. 7-214216, "Production Method of High Strength Spring"

This disclosure describes that a steel wire spring may be electropolished, nitrided, and then subjected to two-stage shot peening using first particles having hardness of Hv 600 to 800 and diameter of 0.6 to 1.0 mm as first-stage shots and then particles having hardness of Hv 700 to 900 and diameter of about 0.05 to 0.2 mm as second-stage shots. However, no further analysis, examination nor consideration on the particle size of 0.05 to 0.2 mm are made. This disclosure reports that, in an example which uses steel balls having a grain diameter of 0.15 mm and a hardness of Hv 800 as the second-stage shots, the fatigue limit of the spring is 637 MPa as a mean stress and ±560 Mpa as an amplitude stress at $5\times10^7$ times of repetition. This does not satisfy expression (1) representing the spring fatigue limit in the 8th embodiment of the present invention. Moreover, the definition of the second-stage particle projection conditions is different from that of the present invention.

7. Japanese Laid-Open Patent Publication No. 5-177544, "Production Method of Coil Spring"

This disclosure relates to a method including nitriding after spring formation and then shot peening the spring. In the shot peening, first-stage shot peening, low-temperature annealing, and second-stage shot peening using shots smaller than those used in the first-stage shot peening are sequentially performed. According to the detailed description of this disclosure, it is preferable, in consideration of the residual stress, to use shots having a size of about 0.05 to 0.20 mm and a hardness of Hv 700 to 900 in the second-stage shot peening and project these shorts under a high pressure. However, no further analysis and description are made on the difference in the effect of particle projection between 0.05 mm dia. particles and 0.1 mm dia. or 0.2 mm dia. particles, and the like. In an embodiment of this disclosure, second-stage shot peening is performed using steel balls having a diameter of 0.1 mm and a hardness of Hv 800 under a projection pressure of 5 kgf/cm$^2$. According to the disclosure, the resultant fatigue limit is $\tau m=686$ MPa as a mean stress and $\tau A=\pm567$ MPa as an amplitude stress at $5\times10^7$ times of repetition. The compression residual stress in a near surface layer does not reach 1400 MPa as seen from FIG. 3. Both values therefore do not satisfy the 8th embodiment of the present invention.

DISCLOSURE OF THE INVENTION

We have pointed out the problems for the respective conventional techniques in the BACKGROUND ART. In the conventional techniques, as shot projection methods for a surface-nitrided spring having a comparatively high surface hardness, projection of cemented carbide particles having diameters from 50 μm to 200 μm has been disclosed (Prior Art Technique 3), and projection of particles having diameters from 20 to 100 μm has been mentioned for improvement of the fatigue property of a steel work and the particle diameter has been limited although roughly (Prior Art Technique 2; similarly, Prior Art Techniques 6 and 7). However, the relationship between a truly effective and appropriate projection method and the performance of the spring which has been subjected to the projection method has been rather unclear.

In Prior Art Technique 3, since the cemented carbide particles used are expensive, the projection particles are presumed to be economically disadvantageous. Moreover, since the fatigue strength of a spring in an embodiment of this disclosure is lower compared with that of the present invention, this technique is not considered to have sufficiently explicated and solved the technical problems.

Hitherto, it has been strongly requested to reduce the size and weight of various kinds of springs for automobiles such as valve springs for internal combustion engines. In view of this request, the object of the present invention is to provide a spring processing method which can further increase the fatigue strength of the springs and thereby realize improvement in the traveling performance of automobiles, improvement in fuel consumption by reducing the size and weight of the automobiles, and the like, and a spring produced by such a method. Technical problems to be overcome to realize a spring with such an excellent performance are to prevent a microcrack from generating and growing from a surface layer of the spring under repeated high stress and to prevent a microcrack from growing from a nonmetallic inclusion existing right under the surface layer of the spring. The 1st and 2nd embodiments of the invention (with a nitriding step), the 4th embodiment (without a nitriding step), and the 6th embodiment (with/without a nitriding step) are directed to technologies challenging these technical problems, and the 8th to 12th embodiments are directed to high performance springs produced by these technologies. These embodiments provide solutions for the above two problems in comparatively economical manners. The 3rd embodiment of the invention is directed to a method for improving the fatigue strength of a comparatively thin sheet or fine wire spring. The 13th embodiment of the invention is directed to a spring produced by the method of the 3rd embodiment. The techniques of the 5th and 6th embodiments of the invention have a greater effect especially in preventing fatigue breaking from the surface layer compared with the technologies of the 1st to 4th embodiments described above.

The 13 embodiments of the invention are described below.

The 1st embodiment of the invention is a spring surface treatment method, comprising the steps of:

(A) nitriding surface layer of springs;

(B) projecting hard metal particles having hardness which is lower than the hardness of the nitrided outermost surface layer (micro-Vickers hardness at a depth of about 5 μm from the outermost surface) and is in the range of Hv 500 to 800 and diameters from 200 to 900 μm against the nitrided surface of the springs at velocity from 40 m/sec. to 90 m/sec., so as to prevent generation of a microcrack in the surface layer by the projection (shot peening) and provide compression residual stress comparatively deep inside the springs; and (c) projecting a number of fine metal particles having a mean diameter of all particles of 80 μm or less, a mean diameter of each particle in the range between 10 μm inclusive and less than 100 μm, a spherical or near spherical shape having no square portions, specific gravity from 7.0 to 9.0, and hardness which falls in the range between Hv 600 and Hv 1100 inclusive and is equal to or less than the hardness of the outermost surface layer of the springs after nitriding or low-temperature carbonitriding at velocity from 50 to 190 m/sec., while controlling an instantaneous temperature rise limit of the iron matrix (excluding the nitride compound layer) of the nitrided spring surface layer due to collision to be low enough to cause work hardening in the spring surface layer but not to cause softening due to recovery/recrystallization, thereby effectively work hardening and preventing generation of any microcracks in the surface layer to provide high compression residual stress and hardness.

The 2nd embodiment of the invention is a spring surface treatment method, comprising the steps of:

(A) projecting a number of metal particles such as iron-based particles having diameters between 10 μm inclusive and less than 100 μm, a mean diameter of all particles of 80 μm or less, more desirably 65 μm or less, mean diameter of each particle of 10 to 80 μm, a spherical or near spherical shape having no square portions, a specific gravity of 7.0 to 9.0, and a hardness of Hv 350 to 900 against the surface of springs before nitriding at collision velocity in the range of 50 m/sec. and 160 m/sec. inclusive so that a temperature rise limit of the surface of the spring due to collision is controlled to be low enough to cause work hardening of the iron matrix of the springs but lower than the point at which recovery/recrystallization may occur so as to prevent generation of any microcracks and the like;

(B) nitriding surface portion of the springs after the step (A);

(C) projecting hard metal particles having hardness which is lower than the hardness of the nitrided outermost surface layer (the micro-Vickers hardness at a depth of about 5 μm from the outermost surface) and in the range of Hv 500 to 800, and a grain diameter of 200 to 900 μm against the nitrided surface of the springs at velocity of 40 m/sec. to 90 m/sec., so as to prevent generation of any microcracks in the surface layer by the projection (shot peening) and provide compression residual stress comparatively deep inside each spring; and (D) projecting a number of metal microparticles having a mean diameter of all particles of 80 μm or less, a mean diameter of each particle in the range between 10 μm inclusive and less than 100 μm, a spherical or near spherical shape with no square portions, a specific gravity of 7.0 to 9.0, and a hardness which falls in the range between Hv 600 and Hv 1100 inclusive and is equal to or less than the hardness of the outermost surface layer of the spring after nitriding or low-temperature carbonitriding at the velocity of 50 to 190 m/sec., while controlling the instantaneous temperature rise limit of the iron matrix (excluding nitride compound layer) of the nitrided spring surface layer due to collision to be high enough to cause work hardening in the surface layer but lower than a point at which softening due to recovery/recrystallization may occur, thereby effectively causing work hardening and preventing generation of any microcracks in the surface layer to provide a high compression residual stress and hardness.

The 3rd embodiment of the invention is a surface treatment method comprised of the step of bombarding hard metal particles having hardness in the range between Hv 350 and 1100, specific gravity of 7.0 to 9.0, a mean diameter of all particles of 80 μm or less, a mean diameter of each particle in the range between 10 μm inclusive and less than 100 μm, and a spherical or near spherical shape with no square portions, on the surface of springs with the surface layer hardness of Hv 400 to 750, which hardness was obtained either by low-temperature annealing for removal of macroscopic residual stress after cold forming, quench and temper after cold forming, or quench and temper after hot forming, at the collision velocity of 50 m/sec to 160 m/sec, while controlling the temperature rise limit of the spring surface layer due to collision to be low enough to cause work hardening in the spring surface layer but not to cause softening due to recovery/recrystallization and preventing generation of any microcracks in the surface layer and the like which may deteriorate fatigue strength, thereby improving the hardness and compression residual stress of the surface layer which is 30 μm to 50 μm or less deep from the surface and resulting in improved endurance of the springs.

The 4th embodiment of the invention is a spring surface treatment method for preventing generation of harmful microcracks in surface layer and the like which may deteriorate fatigue strength and for improving especially the hardness and compression residual stress of the surface layer which is 30 μm to 50 μm or less deep from the surface, to improve endurance of the springs, the method comprising the steps of:

(A) projecting hard metal particles having hardness of Hv 350 to 900 and the particle diameter of 200 to 900 μm against the surface of formed and tempered springs having hardness of the surface layer of Hv 400 to 750 at the velocity of 40 m/sec to 90 m/sec so as to prevent generation of harmful microcracks in the surface layer and provide compression residual stress comparatively deep inside the springs; and (B) performing the surface treatment method according to embodiment 3 on the spring surface after the step (A).

The 5th embodiment of the invention is a spring surface treatment method according to the 1st or 2nd embodiment, wherein the particles having a mean diameter of all particles of 80 μm or less and a mean diameter of each particle in the range between 10 μm inclusive and less than 100 μm and the projection conditions of the particles are limited to the following:

hardness of projected particles: initial hardness (new particles) Hv 600 to 1100 size of projected particles: initial mean diameter of each particle (new particle) 10 μm to 80 μm mean diameter of all particles: 65 μm or less specific gravity of projected particles: 7.0 to 9.0 collision velocity against spring: 60 m/sec. to 140 m/sec.

The 6th embodiment of the invention is a spring surface treatment method according to the 3rd or 4th embodiment, wherein the particles having a mean diameter of all particles of 80 μm or less and a mean diameter of each particle in the range between 10 μm inclusive and less than 100 μm and the projection conditions of the particles are limited to the following:

hardness of projected particles: initial hardness (new particles) Hv 350 to 1100 size of projected particles: initial mean diameter of each particle (new particle) 10 μm to 80 μm mean diameter of all particles: 65 μm or less specific gravity of projected particles: 7.0 to 9.0 collision velocity against spring: 60 m/sec. to 140 m/sec.

The 7th embodiment of the invention is a spring surface treatment method according to the 1st or 4th embodiment, wherein in the step (B) of embodiment 1 or in the step (A) of embodiment 4, the projection of the hard metal particles having a diameter of 0.2 to 0.9 mm is divided into first-stage projection of comparatively large particles having a diameter of 0.5 to 0.9 mm and second-stage projection of comparatively small particles having a diameter of 0.2 to 0.4 mm.

The 8th embodiment of the invention is a spring produced from a circular cross-section wire or a non-circular cross-section wire by the steps according to the 1st embodiment as essential steps, the spring being a coil spring made of any of steel types (1) to (4) containing respective chemical components, a compression residual stress of iron in a near surface layer by X-ray method being greater than 1700 MPa, sizes of a hard nonmetallic inclusion, carbide, carbonitride, nitride, and the like which may cause fatigue breaking of the spring and the hardness of matrix satisfying following X or Y, the spring being a high fatigue resistance strength spring having a fatigue strength at $5\times10^7$ times of repetition satisfying expression (1) below:

in a repeated stress of $\tau m \pm \tau a$, when $\tau m = 800 - x$, $$\tau a \geqq (620 + x/5) \quad (1)$$

where $\tau m$: mean stress, $\tau a$: amplitude stress, and x: variable in the range of 0 and 150 inclusive, (unit: all MPa), X: controlling the hardness of the matrix at a depth in the range of 0.2 mm to 0.5 mm inclusive from the spring surface in the range between Hv 520 and 580 inclusive when the size of a harmful nonmetallic inclusion, carbide, and the like existing in the spring is less than 20 $\mu$m or 15 $\mu$m or less, Y: controlling the hardness of the matrix at a depth in the range of 0.2 mm to 0.5 mm inclusive from the spring surface in the range between Hv 520 and 630 inclusive when the size of a harmful nonmetallic inclusion, carbide, and the like existing in the spring can be controlled to 10 $\mu$m or less, the steel types (1) to (4) being as follows:

(1) a steel type containing as essential components C: 0.50 to 0.80%, Si: 1.20 to 2.5%, Mn: ≦1.20%, and Cr: ≦1.80% and iron and impurities as the remainder, including a steel type with one or two kinds of V: 0.03 to 0.60% and/or Nb: 0.02 to 0.20% added thereto;

(2) a steel type containing one or more kinds of Ni: 0.5% or less and/or Co: 3.0% or less in addition to the steel type (1);

(3) a steel type containing W: 0.5% or less and/or Mo: 0.6% or less and/or Al: 0.5% or less in addition to the steel type (1) or (2); and (4) a steel type containing C: 0.05% or less, Si: 0.8% or less, Mn: 0.8% or less, Ni: 16 to 26%, Ti: 0.2 to 1.6%, Al: 0.4% or less, Co: 8.5% or less, Mo: 5.5% or less, Nb: 0.6% or less (in addition to the above, 0.1% or less of B, Zr, and/or Ca may be added), and unavoidable impurities and iron as the remainder (unit of the chemical components is all mass percent).

The 9th embodiment of the invention is a steel spring excellent in fatigue strength, produced using any of the steel types (1) to (3) in the 8th embodiment, by quenching and tempering, so as to have a higher tensile strength than a JIS SWOSC-V oil tempered wire for valve springs depending on the wire diameter, forming into a spring, and then annealing at low temperature for removal of its residual stress, or by quenching and tempering after spring formation so as to have a higher tensile strength or hardness than a JIS SWOSC-V oil tempered wire for valve springs, or produced using the steel type (4) in the 8th embodiment by performing solution treatment, cold wiredrawing or rolling, forming into a spring, aging, and quality-adjusting so that the tensile strength be 1900 MPa or more, being followed by the steps according to the 4th embodiment, wherein the spring has residual stress near the surface layer in the range between more than 1100 Mpa and 1700 MPa inclusive, the surface hardness is in the range of Hv 600 and Hv 800 inclusive, and when the hardness at a depth of 0.2 mm to 0.5 mm from the surface is in the range of Hv 580 to 630, the size of nonmetallic inclusions are less than 10 $\mu$m or less, and when the hardness at a depth of 0.2 mm to 0.5 mm from the surface is in the range between Hv 520 inclusive and less than Hv 580, the size of nonmetallic inclusions are 15 $\mu$m or less or less than 20 $\mu$m.

The 10th embodiment of the invention is a spring according to the 9th embodiment, wherein the fatigue limit of the spring satifies the folowing:

at a repeated stress of $\tau m \pm \tau a$, and $5 \times 10^7$ times of repetition, $$\tau a \geqq 470 + x/5 \quad (2)$$

when $\tau m = 690 - x$, where x: 0 to 183, and unit: MPa.

The 11th embodiment of the invention is a spring made of cold drawn or warm drawn plano wire, low-alloy steel wire for spring superior in warm creep resistance to the piano wire, or similar steel wire, composed of fine pearlite structure, having the wire diameter in the case of circular cross-section wire, the mean diameter or the mean thickness in the case of the non-circular cross-section wire of 1.5 mm or more, produced by subjecting to low temperature annealing for removal of the residual stress after forming into a spring, projecting hard metal particles having diameter of 0.2 to 0.9 mm, and then projecting a number of fine metal particles having a mean diameter of all particles of 65 run or less, a mean diameter of each particle of 10 to 80 run, spherical or near spherical shape having no square portions, specific gravity of 7.0 to 9.0, and hardness in the range of Hv 350 and 1100 inclusive at velocity of 50 to 160 m/sec, while controlling temperature to be low enough to cause work hardening in the near surface layer but not to cause recovery/recrystallization, and having compression residual stress of 550 MPa or more in the iron matrix of the surface layer by X-ray method and a fatigue limit of:

at a repeated stress of $\tau m \pm \tau a$, and $5 \times 10^7$ times of repetition, $$\tau a \geqq 422 + x/5 \quad (3)$$

when $\tau m = 690 - x$, where, unit: MPa, and x: 0 to 140.

The 12th embodiment of the invention is a spring made of a normal JIS SWOSC-V oil tempered wire for valve springs produced by subjecting to low-temperature annealing for removal of residual stress after formation into a spring, projecting hard metal particles having diameter of 0.2 to 0.9 mm, and then projecting a number of fine metal particles having a mean diameter of all particles of 65 $\mu$m or less, a mean diameter of each particle of 10 to 80 $\mu$m, a spherical or near spherical shape having no square portions, a specific gravity of 7.0 to 9.0, and a hardness in the range of Hv 500 and 1100 inclusive at a velocity of 50 to 160 m/sec. while controlling a temperature to be low enough to cause work hardening in the near surface layer but not to cause recovery/recrystallization, to obtain compression residual stress measured by X-ray method of 900 MPa or more in the near surface layer, hardness at the depth of 0.2 to 0.5 mm from the surface of Hv 520 to 600, sizes of nonmetallic inclusions of 15 $\mu$m or less, and the fatigue limit of:

at a repeated stress of $\tau m \pm \tau a$, and $5 \times 10^7$ times of repetition, $$\tau a \geqq 440 + x/5 \quad (4)$$

when $\tau m = 690 - x$, where, unit: MPa, and x: 0 to 208.

The 13th embodiment of the invention is a sheet spring or wire spring with excellent fatigue strength, of which hardness at the surface layer before shot-peening is Hv 400 to 750, obtained by being projected by metal particles, each of which is characterized by the hardness of Hv 350 to 1100, the mean diameter of 10 to 80 μm, spherical or near spherical shape with no square portions and a specific gravity of 7.0 to 9.0, with the mean diameter of the largest particle and the mean diameter of all particles to be 80 μm and 65 μm, respectively and preferably 75 μm and 50 μm, respectively, at a collision velocity of 50 to 160 m/sec while controlling the projection so as to cause work hardening but not to cause recovery/recrystallization.

The projection velocity as used herein refers to a velocity immediately before the collision of projected particles against the surface of a spring. As the particle projection method, the present invention adopts impeller method and honing method using gas such as air as a carrier. Also, so-called stress peening in which particles are projected against a spring by loading an external stress statically or under a constant strain state may be adopted without losing the effect of projection of particles such as fine particles. Rather, this further improves the compression residual stress in the surface layer providing an effect of preventing fatigue breaking. Therefore, such a method of projecting particles under stress loading is also included in the present invention. It should be noted, however, that the stress peening requires a special exclusive jig or device resulting in cost increase. The 8th to 12th embodiments of the present invention are related to springs subjected to particle projection without stress or strain being applied, and springs with high fatigue strength are obtainable without depending on the stress peening.

A spring may be pre-heated to a temperature of about 100 to 250° C. before being subjected to the microparticle projection according to the present invention. The effect of the present invention is not lost by this method, which is therefore included in the present invention. Also included in the present invention are performing strain age hardening or low-temperature annealing at a temperature of 150 to 250° C. between the particle projection recited in the embodiments of the present invention and the subsequent projection of finer particles and after the final particle projection step, and performing warm/cold setting after the particle projection.

As the stress received by a spring becomes greater, a greater stress is applied on the surface layer of the spring, causing a microcrack when the surface layer is no more durable against repetition of the stress. In order to prevent such a microcrack, it is necessary to put the residual stress in the surface layer in a compressed state and increasing the absolute value of the compressive residual stress as much as possible. It is not possible to provide a compression residual stress exceeding the elastic limit of the material. In order to overcome this, according to the present invention, the elastic limit is simultaneously improved by work hardening of the spring surface layer by fine particle projection, so as to increase the compression residual stress to a high level. At the same time, the yield point and hardness of the spring surface layer are made as high as possible without losing the ductility and toughness of the spring surface layer, so as to prevent sliding deformation due to repeated stress and thus prevent generation and growth of a microcrack in the surface layer. Further, a micro-recess and crack generated in the surface layer may be a source of fatigue cracking. It is therefore necessary to provide precaution and projection conditions which ensure that such a surface defect will not be created in the surface layer during particle projection. In order to satisfy such requirements, according to the present invention, fine metal particles having optimal shape and properties including the diameter between 10 μm inclusive and less than 100 μm, more preferably in the range of 10 to 80 μm, are projected under optimal velocity condition. In particular, it has been found that as the projection velocity and the projection density in the spring surface layer are increased even when the particle projected spring surface temperature does not exceed the A3 transformation point, the spring surface layer produces microcracks or decreases ductility and toughness due to severe deformation even when recovery/recrystallization is not generated, decreasing the fatigue strength to a lower level than that observed when the projection velocity is lower. Thus, a spring having excellent properties can be obtained by projecting microparticles at a temperature which is low enough to prevent generation of such a microcrack in the spring surface layer, lower than the A3 transformation point, and lower than the temperature at which iron matrix causes recovery/recrystallization, so that work hardening or strain age hardening is generated to a sufficient extent but reduction in ductility and toughness and microcracking are not generated. For a spring having a wire diameter of about 2 mm or more or a sheet thickness of about 1.5 to 2 mm or more, it is necessary to first provide the residual stress deep inside the spring by projecting iron-base particles having a diameter of 0.2 to 0.9 mm against the nitrided or non-nitrided spring before performing the fine particle projection described above. This step of projecting particles having a diameter of 0.2 to 0.9 mm may include first projecting particles having a diameter of 0.5 to 0.9 mm and subsequently projecting particles having a diameter of 0.2 to 0.4 mm (the 5th and 6th embodiments).

Roughly three methods as follows are employed for prevention of fatigue breaking due to existence of nonmetallic inclusions under a spring surface layer. One of the methods is reducing the size of non-ductile nonmetallic inclusions found in a spring material. The minimum size (critical size) of a harmful inclusion is smaller as the hardness of the spring is higher. It is about 20 to 15 μm when the hardness of an iron matrix surrounding the inclusion is about Hv 520 to 580. It is about 10 μm when the hardness is about Hv 580 to 630. Therefore, if the size of nonmetallic inclusions existing in the spring material is equal to or more than the critical size, the internal hardness of the spring material must be regulated according to the maximum size of the inclusion. The second method is putting the residual stress of the portion surrounding a harmful nonmetallic inclusion in a compressed state to prevent growth of a microcrack around the inclusion. In order to achieve this, conventionally, round cut wires having a comparatively large diameter of 0.5 to 0.90 mm or up to 1.00 mm are projected at a velocity of 40 to 90 m/sec to provide the compression residual stress down to a depth of 0.2 to 0.5 mm from the surface of the spring. When the wire diameter or sheet thickness of the spring is between 1.5 to 2.0 mm and 2.5 mm, it is necessary to project round cut wires having diameter of 0.2 to 0.4 mm at a velocity of 40 to 90 m/sec so that the compressive residual stress is provided down to a depth of about 0.06 to 0.13 mm and prevent breaking of the spring from inclusions. In these cases, if the projection velocity is excessively high, non-uniform deformed areas may be locally produced in the surface layer of the spring material, generating micro-recesses and cracks in the surface layer, which tend to cause fatigue breaking from the spring surface layer. It is therefore required to effect projection as described above so as not to cause such a defect. In order to prevent generation of such a microcrack and the like, the maximum projection velocity must be determined for each specific spring with 90 m/sec being the upper limit. If the projection velocity is lower than 40 m/sec., the residual stress providing effect is reduced failing to provide the residual stress sufficiently deep. The minimum projection velocity was therefore set at 40 m/sec.

The third method is decreasing the hardness of the spring material in which inclusions exists. Decreasing the hardness excessively, however, increases the creep which is one of critical properties of the spring, spoiling the performance of the spring. Therefore, this method must be avoided from being adopted thoughtlessly. In view of this point, in the 8th to 10th embodiments, the hardness at a depth of 0.2 to 0.5 mm is set to be at least Hv 520 or more. Normally, fatigue breaking originating from an inclusion occurs at a depth of 0.2 to 0.5 mm from the surface of a spring, and the hardness of the iron matrix in this depth region and the fatigue breaking have a close relationship. By controlling the mean size of each inclusion including harmful carbide, nitride, boride, and the like which appears on fracture surface to be less than 20 $\mu$m or not more than about 15 $\mu$m at steel mill and in wire mill where the size of carbide and the like may be controlled by heat treatment and the like, when the hardness is Hv 520 to 580 in this depth region, fatigue breaking due to existence of an inclusion and the like can be prevented. In the 8th embodiment of the present invention, the hardness at a depth of 0.2 to 0.5 mm is limited to Hv 630 or less, since in the 9th embodiment of the present invention, fatigue breaking due to an inclusion and the like can be prevented when the hardness at a depth of 0.2 to 0.5 mm is Hv 630 or less if the mean size of an inclusion appearing at a spring fracture surface can be controlled to be 10 $\mu$m or less. The limitation of an inclusion in the 9th embodiment for a high strength spring non-nitrided has substantially the same purpose as above, where the maximum size of the inclusion is limited depending on the hardness. In the 12th embodiment, the relationship between the maximum size of an inclusion in a silicon chrome steel spring non-nitrided and the hardness thereof is limited. In this case, since the hardness at a depth of 0.2 to 0.5 mm is Hv 520 to 600, the size of the inclusion is required to be about 15 $\mu$m or less.

The state of an inclusion in a spring material is different among the types or kinds of the spring material. That is, in general, as the addition amount of an alloy of Si, Cr, Mo, V, Nb, W, Al, and the like increases, the level of a non-ductile nonmetallic inclusion in the spring steel material may be deteriorated. In the case of piano wires, it is possible in many cases to substantially eliminate inclusions having a size of 10 $\mu$m or more by the existing technique. In the case of alloy steel all tempered wires for valve springs, there exist harmful inclusions such as $Al_2O_3$ (alumina), MgO $Al_2O_3$ (spinel), $SiO_2$ (silica), and the like. These hard non-ductile oxide-based inclusions can be made harmless by controlling the morphology to change to ductile inclusions during steelmaking. In the case of steel materials for springs including a comparatively large amount of elements such as V, Nb and Ti, the following measures must be taken. Since a carbide, a nitride, or a carbonitride such as VC, NbC, TiC and TIN keep their spherical or angular shapes, such inclusions must be made harmless or production of such inclusions must be avoided by measures such as examining the heating conditions at rolling and annealing, and preventing the entry of Ti and the like from raw materials at the steelmaking stage. In order to prevent fatigue breaking of a spring due to existence of a harmful inclusion, it is desirable to reduce the content of V, Nb, Ti, and the like in a steel material for the spring to the minimum. In the steel type (1) in the 8th embodiment, 0.03 to 0.60% of V and/or 0.02 to 0.20% of Nb are added to be effective in reducing the size of crystal grains, improving the ductility and toughness of the spring and promoting nitriding. Ni added to the steel type (1) has an effect of improving the ductility and toughness of spring steel and is also considered to be effective in preventing fatigue breaking and fatigue crack spreading in a high strength spring. However, if the added Ni exceeds 0.5%, generation of residual austenite will be facilitated during processing of wire rods and wires, resulting in unintentionally reducing the ductility and toughness of the spring steel during the production. The upper limit is therefore set at 0.5%. Addition of Co to the steel type (1) reduces the transformation time during cooling from a high temperature such as during pearlite transformation, providing an effect of, for example, causing metallographic change to fine pearlite having good cold processability during production of wires. This facilitates the production of wires. If the addition of Co exceeds 3.0%, the effect reduces in comparison with the cost since Co is an economically expensive element. Therefore, the upper limit is set at 3.0%.

The addition of Mo, Cr, and Al to the steel type (1) or (2) in the 8th embodiment facilitates the entering of nitrogen during nitriding. For any of these elements, if the addition amount of the element is excessively large, a nitride compound is deposited near the surface of the spring, which prevents nitrogen to diffuse and permeate toward the depth of the spring, resulting in reducing the effect of improving the fatigue resistance of the spring. According to the present invention, in view of this point, the upper limit of the addition amounts of Mo, Cr, and Al were set at 0.6%, 1.8%, and 0.5% by mass, respectively. W enhances heat resistance and is effective in preventing decarburization of the spring. However, if the addition amount of W to the steel type (1) or (2) exceeds 0.5%, quenching ability becomes excessive and thus a larger number of times of annealing is required, increasing the complexity and cost of production. Therefore, the upper limit is set at 0.5%. In the steel type (1), C is required to improve the strength of the steel and fatigue strength. Since this effect decreases if the content is less than 0.5%, the lower limit is set at 0.5%. If the content of C exceeds 0.8%, the effect of improving the strength decreases and brittleness is exhibited. Therefore, the upper limit is set at 0.8%. If a decarburization layer is formed in the surface layer, the hardness is compensated by nitriding as far as the degree of the decarbonization is not extremely large. Accordingly, the method according to the present invention is also applicable to such decarbonized materials. Si provides good effects on the strength and creep resistance of the spring. For a spring which is strengthened by quenching and tempering, the effects are weak if the content of Si is less than 1.2%, but if it exceeds 2.5%, processability tends to be lowered due to promotion of decarburization and reduction in ductility and toughness during production. Therefore, the lower and upper limits are set at 1.2% and 2.5%, respectively, for the steel type (1).

Maraging steel having the component shown in (4) in the 8th embodiment also has the effect of improving the fatigue strength. Accordingly, the 8th embodiment includes this steel as the steel type (4), Maraging steel becomes comparatively soft martensite by alloy element solution treatment and austenitization (solution treatment) under a high temperature of about 800 to 900° C. and the following cooling. The resultant martensite structure material is subjected to cold wiredrawing and work hardened. This wire is formed to springs. Thereafter, aging at a temperature near 500° C. is performed to obtain the strength and spring nature. Nitriding is then performed to increase the fatigue strength in a manner according to the 1st or 2nd embodiments. Alternatively, a spring having an excellent fatigue strength can be obtained without nitriding according to the 3rd or 4th embodiments. Maraging steel springs have superior creep resistance to low alloy steel wire springs, and thus exhibits its performance with a tensile strength after aging of 1900 MPa or more (the 9th embodiment). This is therefore especially suitable for applications requiring creep resistance and fatigue resistance. The solution treatment is a heat treatment employed for high-alloy steel such as stainless steel and high manganese steel, in which carbide precipitates and the like are dissolved in the structure of the steel during high temperature heating and then rapidly cooled to room temperature without allowing re-precipitation of them.

The present invention includes: (1) a spring subjected to nitriding during the processing (including low-temperature carbonitriding aiming mainly at addition of nitrogen) (the 8th embodiment) and a production method thereof (the 1st, 2nd, 5th, and 7th embodiments); and (2) a spring not subjected to nitriding or low-temperature carbonitriding (the 9th to 13th embodiments) and a production method thereof (the 3rd, 4th, 6th, and 7th embodiments).

As for the spring (1) to be nitrided, pickling, electropolishing, shot peening, and the like are conventionally known as a descaling treatment performed before nitriding. Pickling is not suitable for the present invention since it has problems such as generation of a microcrack due to hydrogen brittleness on the spring surface. Electropolishing has problems such that large-scale equipment is necessary when applied to mass production. Therefore, the present invention adopts shot peening (particle projection) for descaling before nitriding. In this treatment, the projection velocity, the diameter of particles projected, and the like must be adjusted so as not to generate a harmful surface microcrack and a local shear deformation band. Such a surface defect due to the particle projection before nitriding is left after the nitriding. When particle projection is performed for descaling before nitriding, comparatively large particles having a diameter of 0.3 to 0.8 mm made of steel and the like may be projected at a velocity in the range of 40 to 90 m/sec so as not to damage the surface layer of the spring. When the spring is stressed, neighboring wire rings are likely to be in contact with each other especially at ends of the spring. It has been found that, in order to descale such inter-wire contact portions sufficiently to promote entrance of nitrogen during nitriding and thus prevent fatigue breaking from the end portions of the spring, it is effective to project first particles having a diameter of 0.3 to 0.8 mm as described above and then fine particles having a diameter in the range between 10 $\mu$m inclusive and less than 100 $\mu$m, more desirably 10 to 80 $\mu$m. It has also been found that the projection velocity is 50 to 160 m/sec., more preferably 60 to 140 m/sec in order to project fine particles without generating a microcrack and a local deformation band harmful to fatigue in the surface layer, and that it is effective for prevention of a surface defect to control the temperature in the spring surface layer during the fine particle projection to be lower than the temperature at which recovery/recrystallization occurs. It has been found that when the temperature of nitriding is in the range of about 500° C. to 450° C. inclusive, although the surface plastic deformation region by the fine particle projection is comparatively shallow, nitrogen enters to a depth which is not so different from the projection of 0.3 to 0.8 mm dia. particles. Therefore, it is also effective to perform only the fine particle projection omitting the projection of 0.3 to 0.8 mm dia. particles. Based on such purpose and reason, the 2nd embodiment limits the projection conditions.

The nitriding or the low-temperature carbonitriding is performed at a temperature of about 500° C. or less to introduce mainly nitrogen, optionally partly carbon additionally, to the spring surface portion. As a result of the nitrogen (optionally, with a small amount of carbon) entering the spring surface portion, large compression residual stress is provided in the surface portion. The fine particle projection according to the present invention is recognized to be effective even on a comparatively hard spring having a surface hardness of about Hv 800 to 1100 after nitriding. When 0.2 to 0.9 mm dia. particles are projected after the nitriding, the compression residual stress is provided to a further deeper portion compared with the case where this post-nitriding particle projection is not performed. This is effective in preventing fatigue breaking from a nonmetallic inclusion or a microcrack at a depth from the surface to 0.5 mm deep.

After the projection of comparatively large iron-based particles having a diameter of 0.2 to 0.9 mm as described above, fine metal particles according to the present invention is projected under optimal conditions. By this processing, fatigue breaking both from the surface layer and from an internal nonmetallic inclusion can be prevented even under repeated high stress loading.

The post-nitriding particle projection is performed as follows. First, hard metal particles made of steel and the like having a diameter of 200 to 900 $\mu$m and having hardness which is Hv 500 to 800 and softer than the hardness of the outermost surface layer of the treated spring (the micro-Vickers hardness at a depth of about 5 $\mu$m from the outermost surface), are projected at a velocity of 40 to 90 m/sec, so as to provide the compression residual stress down to a comparatively deep portion inside the spring while preventing generation of a harmful microcrack in the surface layer (the 1st and 2nd embodiments). Alternatively, particles having a diameter of 0.5 to 0.9 mm and a hardness of Hv 500 to 800 and then particles having a diameter of 0.2 to 0.4 mm and a hardness of Hv 500 to 800 are projected, so as to provide a high compression residual stress inside the spring including a portion comparatively near the surface layer while preventing generation of a harmful microcrack and the like in the surface-layer (the 7th embodiment).

Subsequently, metal particles having hardness, Hv 600 to 1100 which is equal to or less than the hardness of the outermost surface layer of the nitided spring before the above particle projection, a spherical or comparatively near spherical shape, a mean diameter of all projection particles of 80 $\mu$m or less and a mean diameter of each particle between 10 $\mu$m inclusive and less than 100 $\mu$m, more desirably a mean diameter of all projection particles of 65 $\mu$m or less and a mean diameter of each particle of 10 to 80 $\mu$m, and a specific gravity of 7.0 to 9.0, are projected at a velocity of 50 to 190 m/sec., more preferably 60 to 140 m/sec. (hereafter, such a technique of projecting hard metal microparticles is referred to as "SS treatment").

FIG. 1 is the experimental results showing the influence of the collision velocity of projecting fine particles on the compression residual stress near the surface of a spring which had been bombarded by high-carbon steel particles having a diameter of 0.6 mm (hardness: Hv 550) at a velocity of 70 m/sec as the first step shot-peening. The spring contained C: 0.60%, Si: 1.45%, Mn: 0.68%, Ni: 0.28%, Cr: 0.85%, and V: 0.07% (unit: mass percent) and had a surface hardness of Hv 930 after nitriding and the first shot-peening. It is observed from this figure that the collision velocity of around 95 m/sec is optimal at which the compression residual stress is as high as 1900 (N/mm$^2$) or more both in the outermost surface layer and at a depth of 10 μm from the surface. In this experiment, the nominal diameter of the projected particles was 50 μm, the mean diameter of all particles was about 63 μm for initial (new) products measured for n=60, the mean diameter of the largest particle was 80 μm or less, and the mean diameter of the smallest particle was 50 μm. The shape of the particles-was a sphere or an ellipsoid close to a sphere in which a majority of the particles have a ratio of maximum to minimum diameters of 1.1 or less with an extremely small part thereof having the ratio of 1.5 or more but having no square sharp edges. The mean hardness was Hv 860 and the specific gravity was 8.2. The projection was performed while controlling the temperature so that the instantaneous temperature rise limit of the iron matrix of the surface nitride layer of the spring (excluding a nitrogen compound portion) generated by the collision is low enough to allow work hardening to occur effectively under interaction with nitrogen atoms and is lower than a temperature at which softening occurs due to recovery/recrystallization of the spring surface layer. Confirmation that such temperature control is under way is performed by a technique such as micro-Vickers hardness measurement, high magnification observation using an electron microscope for the surface of a sample work after the shot peening etc.

As observed from the experimental results in FIG. 1, the maximum compression residual stress value near the surface layer (from the outermost surface layer to a depth of 10 μm from the surface) exceeds 1800 MPa in the range of velocity v of 90 to 152 m/sec., exhibiting a good distribution. In particular, at v=90 m/sec., the compression residual stress on the outermost surface is about 2000 MPa and the distribution is good, indicating that the effect of improving fatigue strength is great. In other words, in the projection of high-speed steel particles having a mean diameter of all particles of 63 μm at v≦152 m/sec., there are hardly generated defects which may possibly deteriorate the fatigue life, such as a local adiabatic shear band near the work surface and a crack in a nitride compound layer. However, when the velocity exceeds 170 to 190 m/sec in the same particle projection, a microcrack and a strong deformation band appear near the surface, and also the residual stress becomes lower than the case of a lower velocity. In view of the above, according to the present invention, the upper limit of the fine particle projection velocity is set at 190 m/sec. If the micorparticle projection velocity is more than 190 m/sec, a microcrack is generated on the nitride surface, or the effect of improving fatigue resistance decreases because the surface layer becomes brittle by processing. The size of the fine particles influences the fatigue strength of the spring in such a manner that when square sharp particles exist among the projected particles, the effect of improving fatigue strength decreases, and that when large particles having a mean diameter of 100 μm or more exist, the effect of improving fatigue strength is lost. Further, the following is observed: The shot velocity at the crossing of the stress curves for the outermost surface layer and the depth of 10 μm from the surface is 95 m/sec. In the range of the shot velocity covering 20% with this crossing as the center (76 to 114 m/sec.), the surface compression residual stress is 1800 MPa or more, indicating that a large compression residual stress can be obtained over a comparatively thick surface layer. It should be noted that the improvement of fatigue strength is more expected in a lower velocity range than the range where the maximum compression residual stress value is obtained in the surface layer down to the depth of 10 μm from the surface. That is, the residual stress is about 1700 MPa or more at a projection velocity of 60 m/sec. or more, providing good fatigue test results. Similarly, especially good results of the fatigue property are expected at a projection velocity of 130 to 150 m/sec with a mean velocity of 140 m/sec or less. Accordingly, the desirable velocity range of the present invention is set at 60 to 140 m/sec. FIG. 2 shows a residual stress distribution when fine particles having a mean diameter of all particles of 63 μm are projected at velocities of 90 m/sec and 190 m/sec.

Next, the same experiment as that described above was performed using this time steel particles having a little lower hardness, Hv 700, and a nominal mean diameter of all particles of 50 μm, a real mean diameter of all particles of 40 μm, and a maximum diameter of about 75 μm. As a result, when the velocity was 190 m/sec., generation of a microcrack in the compound layer and local flaking thereof were observed as in the case of the projection of high-speed steel particles. When the velocity was 60 to 140 m/sec., the maximum compression residual stress near the surface layer exceeded 1700 MPa although this was slightly lower than in the case of the projection of high-speed steel particles, indicating that a large effect is expected for improvement of durability. In this experiment, the surface hardness of a nitrided sample spring was about Hv 930. The surface hardness of the spring after the fine particle projection increased only slightly to about Hv 950. It was however confirmed that a large compression residual stress was formed on the work surface layer by projecting particles having hardness equal to or less than that of the work outermost surface layer. FIG. 3 is a view obtained by projecting particles having different sizes against a spring of the same type as that used in the experiment shown in FIG. 1 in which 0.6 mm dia. high-carbon steel particles were projected against an oil tempered wire for high-strength valve springs after nitriding. The X axis of this figure represents the initial nominal diameter of projected particles (the nominal diameter indicated on a bag of new particle), and the Y axis thereof represents the surface compression residual stress. The material of the projected particles for all the sizes is high-speed steel having a specific gravity of 8.2. The initial mean hardness of the particles is Hv 860 for the nominal diameter of 50 μm (the initial mean diameter of all particles is about 63 μm as actually measured), and becomes lower as the nominal diameter is greater. When the nominal diameter is 200 μm, the hardness is Hv 770. The numbers in the figure represent the collision velocities (unit: m/sec.) of particles against the spring surface. It is evident from this figure that the effect of providing a compression residual stress on the surface greatly decreases in the projection of particles having a nominal diameter of 100 μm compared with the case of the nominal diameter of 50 μm. The mean diameter of the largest particle among new particles having a nominal diameter of 100 μm was 125 μm. Similarly, the mean diameter of the largest particle among new particles having a nominal diameter of 50 μm was 80 μm (both are measurement results of n=60). All particles were free from sharp edges, and the shape thereof was mostly a sphere and partly an ellipsoid comparatively close to a sphere.

Fine particles having sharp edges are not desirable since they tend to deteriorate fatigue characteristics. Also, if the variation in the diameter of fine particles having a mean diameter of 44 μm is large and particles having a diameter in the range of 90 to 105 μm inclusive are mixed in the rate of at least several percents, the effect of improving fatigue strength decreases compared with the case of particles having a mean diameter of 44 μm and a maximum diameter of about 75 μm. Thus, while the effect of improving fatigue strength of a spring is influenced by the mean diameter of all projected particles, the fatigue strength is deteriorated by inclusion of particles having a large maximum diameter. In view of this, according to the present invention, the upper limit of the size is set at less than 100 μm, more preferably 80 μm, since inclusion of particles having a diameter greater than 80 μm actually decreases the effect of improving fatigue strength although it provides the effect. It should be noted that a projected particle having its own mean diameter smaller than the mean diameter of all particles or the nominal diameter does not hinder the projection effect if it has a spherical or near spherical shape having no square portions, a specific gravity of 7.0 to 9.0, and hardness in the range of Hv 700 to 1100 inclusive. Rather, when the mean diameter of each particle is smaller than 50 μm, such particles are effective in increasing the hardness and compression residual stress of the outermost surface layer of the spring. However, as the particle diameter is smaller, the hardness and the thickness where the residual stress is influential become smaller. Accordingly, in the treatment method according to the present invention (the 1st, 2nd and 5th embodiments), the mean diameter of all particles of 20 μm or more is set as a preferable condition. Existence of a small amount of microparticles having a diameter of 10 μm or less is accepted by the present invention if the properties such as the shape and the specific gravity conform to those of particles defined in the embodiments since the projection effect will not be influenced by an inclusion of a comparatively small amount of such particles. In general, as the nominal diameter of projected particles is smaller, it is more difficult to produce or use the particles without a variation in the size. Accordingly, even if the nominal diameter is determined, since the particle diameter has a distribution, a good effect will not be obtained unless this distribution is not taken into consideration in selecting particles.

When the hardness of the nitrided surface layer of a spring is about Hv 850 or more, part of kinetic energy possessed by projected particles at collision is consumed for deforming the surface layer of the spring even when the particles have a hardness equal to or less than that of the spring surface layer, resulting in increasing the temperature of the surface layer although instantaneously. This is considered to promote yield and plastic deformation of the nitrided spring surface layer, thereby facilitating dislocation multiplication by interaction between interstitial nitrogen atoms in solid solution and moving dislocations and developing hardening by dislocation pinning. As the hardness of fine particles becomes lower than Hv 600, the efficiency of generating a residual stress on the spring surface layer decreases. Therefore, the lower limit of the hardness is set at Hv 600. However, since deformation of the spring surface layer and generation of a compression residual stress are possible when the hardness is Hv 500 to 600, the lower limit of the hardness may optionally be Hv 500 or more. When the hardness of the projected particles is higher than that of the nitrided spring surface, a microcrack tends to be generated from the spring surface, spoiling the fatigue strength. According to the present invention, therefore, the upper limit of the hardness of the particles is set at a value equal to or less than the hardness of the spring surface.

Hereafter, "work hardening under interaction with nitrogen atoms" will be described. An iron-based nitride compound such as an epsilon iron nitride may sometimes be formed on the surface of a nitrided spring steel material. Further, inside the material, comparatively fine iron nitride is formed by some part of nitrogen atoms which have diffused and permeated in the steel, contributing to an increase in hardness. Besides the above, interstitial nitrogen atoms exists in the iron matrix, which contribute to improvement of the compression residual stress. The interstitial nitrogen atoms resist against plastic deformation during the SS treatment. Once the work surface layer starts plastic deformation, however, the interstitial nitrogen atoms are influenced by heating as a dislocation is activated kinematically, fixing at least part of the dislocation in the course of an increase of the diffusion velocity of nitrogen atoms in the iron and facilitating dislocation multiplication to reduce the size of dislocation cells (sub-grains). This is considered to contribute to preventing generation of a sliding deformation band due to repeated stress in the spring surface layer during use of the spring and, as a result, preventing generation of a microcrack causing fatigue breaking. Nitrogen has a considerably greater solid solubility compared with carbon. Moreover, coexistence with manganese, silicon, and the like in the steel is considered to increase the solid solubility to a markedly higher level compared with the case of an iron-nitrogen two-element based steel. In view of this aspect, as well as that described above, the nitriding and the subsequent SS treatment for the spring steel are very effective for improvement of the spring properties.

According to the present invention, in consideration of the influence of the size of projected particles as described above, the initial mean diameter of all particles is 80 μm or less, the diameter of each particle is in the range of 10 μm inclusive and less than 100 μm, the shape of the particles is spherical or near spherical having no square corners, the specific gravity is 7.0 to 9.0 mainly in consideration of a steel material which is inexpensive and easily available, and the hardness is in the range of Hv 600 to 1100 and equal to or lower than the hardness of the spring surface layer before being subjected to the particle projection. More preferably, the initial mean diameter of all particles is between 65 to 50 μm and 20 μm, and the mean diameter of each particle is 80 μm or less.

Next, the method according to the present invention directed to improving the fatigue strength of the spring (2) which is not subjected to nitriding (and low-temperature carbonitriding) will be described.

Conventionally, in order to increase the compression residual stress of the surface of a spring without nitriding or low-temperature carbonitriding, (i) shot peening is managed to be improved by use of a material having a higher strength than the conventional material, or (ii) shot peening is managed to be improved by use of the same conventional material. The following methods are known for improving the shot peening indicated in (i) and (ii): A method in which a stress is previously loaded on the spring before particle projection (stress peening); a method in which particle projection is performed in two or three stages sequentially reducing the projection particle diameter; and a method in which particle projection is performed while the spring is heated to become warm. As the spring becomes strong, the elastic limit thereof improves, providing a higher residual stress. However, as described in Prior Art Technique 4, Japanese Laid-Open Patent Publication No. 64-83644, "High-strength spring" mentioned above, for example, when a compression residual stress of 1079 MPa (110 kgf/mm$^2$) or above is provided near the surface of a high-strength oil tempered wire, which has a tensile strength higher than that of a silicon chrome steel oil tempered wire for valve springs specified in JIS G3561 (1994) and has a chemical composition different from the JIS specification, by the conventional technique, the reliability of the spring properties decreases. This is considered because generation of a microcrack on the surface is also influential in addition to the residual stress. According to the present invention, however, the following have been found. By the method according to the 4th embodiment, the 6th embodiment based on the 4th embodiment, or the 7th embodiment based on the 4th embodiment, without nitriding, a compression residual stress of about 1200 to 1600 MPa is obtained on the outermost surface of a spring formed from a high-strength oil temper wire for valve springs, partly because the elastic limit of the spring material is increased by an increase of the strength of the spring, and also a microcrack and the like which may deteriorate fatigue strength can be prevented. The high strength of a high-strength oil temper wire should suitably be a tensile strength higher than that of the JIS silicon chrome steel oil tempered wire for valve springs which is presently applied to valve springs worldwide, for example, a tensile strength exceeding 2060 MPa for a wire diameter of 2.6 mm, a tensile strength exceeding 2010 MPa for a wire diameter of 3.2 mm, a tensile strength exceeding 1960 MPa for a wire diameter of 4.0 mm, and a tensile strength exceeding 1910 MPa for a wire diameter of 5.0 mm. A wire having a level of tensile strength increased by about 300 to 200 MPa from the above values for respective wire diameters is suitable. The reason is that an excessively high tensile strength degrades the spring formability and causes fatigue breaking due to a minute defect such as a nonmetallic inclusion, although it is advantageous in the provision of the residual stress. The 9th and 10th embodiments are directed to high fatigue strength springs obtainable using such a high-strength material without nitriding. It has also been found that a high residual stress and improvement of fatigue strength can be realized by the method according to the present invention for pearlite steel reinforced by wiredrawing or rolling according to the 11th embodiment, a general-use JIS silicon chrome steel oil tempered wire according to the 12th embodiment and a thin-plate spring and fine-wire spring according to the 13th embodiment, and the like. In step (B) of the method according to the 4th embodiment, the material of the projected fine particles is high-carbon steel, high-speed steel, or the like which is similar to that of the spring and thus has an elastic modulus equal to the spring. Accordingly, elastic deformation is distributed to occur at the spring surface and the projecting particles simultaneously. This is considered to be a factor of suppressing generation of a microcrack and excessive deformation of the surface layer which deteriorate fatigue strength, together with the fact that the particles are fine and have no square corners. The large increase in the surface compression residual stress by fine particle projection as described above is related to introduction of dislocations due to large plastic deformation and development of fixation of a large number of such introduced dislocations by carbon atoms repeated with particle collision. More specifically, the supply of carbon atoms facilitates multiplication of dislocations for the following reason. That is, carbon originally existing in the material for the spring in the form of an iron carbide is made thermodynamically unstable by very-short-term high pressure and temperature rise due to fine particle projection, decomposing part of such carbon in a short time. Resultant free carbon atoms diffuse around the dislocations relieving the elastic stress field of the dislocations and also resisting against movement of the dislocations, thereby facilitating multiplication of the dislocations. This results in reducing the size of dislocation cell structures, and providing hardening and a high compression residual stress to the surface layer without losing the toughness and ductility. However, in the maraging steel (4) scarcely containing carbon according to the 8th embodiment, it is considered that the increase in the dislocation density, not the decomposition of the iron carbide, mainly contributes to the increase in the compression residual stress and hardness near the surface by fine particle projection (when nitrided, decomposition of a nitride compound and reduction of mobility of dislocations due to dislocation fixation facilitate an increase of dislocation density and dislocation fixation).

FIG. 4 shows the influence of the projection velocity of iron-based fine particles having a nominal diameter of 50 $\mu$m on the post-projection bending fatigue strength of a plate made of a fine pearlite consisting of C: 0.57%, Si: 1.5%, Mn: 0.7%, Cr: 0.68% (units are all mass percents), and impurities and iron for the remainder, subjected to cold wiredrawing and subsequent cold rolling, having a thickness of 0.97 mm and a mean surface hardness of Hv 537 to 589 (for high-carbon steel particles, the initial mean hardness is Hv 865, the specific gravity is 7.5, the mean diameter of all particles is 37 $\mu$m, the mean diameter of each particle distributes in the range of 10 to 75 $\mu$m, and the shape is spherical or near spherical having no sharp edges; for high-speed steel particles, the initial mean hardness is Hv 860, the specific gravity is 8.2, the mean diameter of all particles is 63 $\mu$m, the maximum particle mean diameter is 80 $\mu$m, and the minimum particle mean diameter is 50$\mu$m, both as actually measured for n=60). It is observed from this figure that the optimal projection velocity exists around a collision velocity of 100 m/sec. When high-carbon steel particles are projected at collision velocities of 107 m/sec. and 183 m/sec., the compression residual stress on the outermost surface was 950 MPa for both collision velocities. In spite of this fact, the fatigue strength of the former is higher than that of the latter. This indicates that generation of a microcrack in the surface layer or the ductility and toughness of the spring surface are influential in addition to the residual stress. More specifically, generation of a microcrack and reduction in the ductility and toughness in the spring surface layer are considered to have occurred when the projection velocity is 183 m/sec. Thus, when the projection velocity is 183 m/sec, the effect of improving fatigue strength is smaller than the case of the projection velocity of 160 m/sec or less although the effect is recognized. Accordingly, in the 3rd, 4th and 6th embodiments, the fine particles projection velocity is set at 160 m/sec. or less, more preferably 140 m/sec. or less. If the projection velocity is less than 50 m/sec, the effect of improving fatigue strength decreases. Therefore, the lower limit is set at this value. More preferably, the lower limit is set at 60 m/sec. Also, particles were projected against the same types of springs as the processed springs shown in FIG. 4 by varying the mean diameter of all particles. As a result, as the nominal diameter of projected particles as new particles increased to 100 $\mu$m, 200 $\mu$m, and 300 $\mu$m, the fatigue strength of the springs after particle projection drastically decreased (FIG. 5). The reason why the effect of improving fatigue strength decreases as the particle size increases is considered that the effect of providing the compression residual stress in the near surface layer decreases and also the degree of increase of the hardness decreases among other reasons. Accordingly, according to the present invention, the mean diameter of all particles is set at 80 $\mu$m or less and the mean diameter of each particle is set at less than 100 $\mu$m. If these values are exceeded, the effectiveness decreases although it exists.

According to the present invention, the minimum mean diameter of metal particles projected to the non-nitrided spring surface was set at 10 $\mu$m for the reason that if the minimum mean diameter is less than this value, the depth at which the compression residual stress arrives by the projection is several micrometers or less, indicating that the depth where a sufficient compression residual stress is obtained decreases. However, particles having a diameter of 10 μm or less may be included without lowering the quality if the inclusion is a small amount. The maximum mean diameter was set at less than 100 μm for the reason that if the maximum mean diameter is this value or more, the effect of improving the residual stress and hardness of the surface layer decreases.

The maximum mean diameter of all projected particles was set at 80 μm for the reason that the effect of improving endurance is greater than the case of the mean diameter of all particles of 100 μm. The specific gravity was set at 7.0 to 9.0 for the reason that it was intended to utilize particles made of steel material which is comparatively inexpensive and easily available. Compared with the elastic modulus of a steel spring of about 196 $GN/m^2$, that of a spring made of cemented carbide is 450 to 650 $GN/m^2$. In the latter case, elastic deformation and plastic deformation are likely to concentrate on the surface layer of the target spring rather than on the projected particles. In the case of cemented carbide, therefore, the unevenness of the surface is comparatively large, and non-uniform deformation such as an adiabatic shear deformation band tends to be easily generated. According to the present invention, the density is set at 7.0 to 9.0 intending to use iron-based particles partly for the purpose of avoiding excessive concentration of deformation on the spring to be processed.

The lower limit of the hardness of projected particles against the non-nitrided spring was set at Hv 350 because, while the surface hardness of a spring to be processed is in the range of Hv 400 to 600 in many cases, the effect of the present invention is also obtained using particles having hardness even slightly lower than the hardness of the object to be processed.

The upper limit of the hardness of projected particles was set at Hv 1100 because Hv 1100 is the upper limit of the hardness of steel particles which are comparatively inexpensive and because the effect of improving fatigue resistance is sufficiently recognizable if the hardness is Hv 1100 or less.

The lower limit of the projection velocity of hard metal particles having a diameter in the range between 10 and less than 100 μm, a specific gravity of 7.0 to 9.0, and the hardness of Hv 350 to 1100 was set at 50 m/sec. because, if it is less than this value, the projection energy given to the particle projection area is short, failing to improve the endurance sufficiently. The upper limit of the projection velocity of the above particles was set at 160 m/sec. because, if it exceeds this value, the projection energy given to the particle projection area is excessive. As a result, the compression residual stress in the spring surface layer becomes lower than the case using the lower projection velocity, and generation of a microcrack in the surface layer is facilitated, whereby the effect of improving spring endurance decreases in comparison with the consumed energy.

Two types of non-nitrided thin sheet spring samples corresponding to the spring shown in FIGS. 4 and 5 described above were produced by projecting high carbon steel particles having a mean diameter of all particles of 37 μm and a hardness of Hv 865 at a velocity of 90 m/sec. These samples were produced in the same process except that final low-temperature annealing at 230° C. was performed for one type while it was omitted for the other. Then, a creep test at 160° C. was performed for both spring samples. As a result, it was found that the spring without the final 230° C. low-temperature annealing had the same degree of creep as the spring subjected to this annealing, both of which exhibited excellent creep resistance. Meanwhile, spring samples were produced by projecting steel shots having a diameter of 0.3 mm at a velocity of 100 m/sec., and the same test was performed. As a result, it was found that the sample which had been subjected to the final low-temperature annealing exhibited better creep resistance than the sample without the annealing.

The reason for the above is considered to be that deformation of carbides in the steel of the former was more active than that of the latter, producing a comparatively larger number of free carbon atoms decomposed with the help of this deformation, and that such free carbon atoms was probably effective in blocking the movement of dislocations during the creep test. However, when short-term setting was performed for the above two types of springs with and without the 230° C. low-temperature annealing at room temperature under the same stress condition, the spring without the annealing exhibited greater setting creep than the spring with the annealing.

From the above results, it is found that only the projection of hard metal microparticles is insufficient for fixation of dislocations generated in the spring surface layer by the projection. The reason why the creep by the 160° C. creep test is irrespective of whether or not the 230° C. low-temperature annealing has been performed is that deformation and disappearance of the iron carbides, i.e., cementites in the spring surface portion are more decomposed by projection of hard fine metal particles compared with by projection of 0.3 mm dia. metal particles, allowing for short-term development of strain aging due to carbon atoms decomposed during the temperature rise to 160° C. It is presumed, however, that the temperature rise due to instantaneous heating of the spring surface layer subjected to particle projection is substantially in inverse proportion to the diameter of projected particles. The reason is considered as follows: The time required for deformation of the spring surface layer by the collision of particles is in proportion to the particle diameter if the hardness of the particles and the quality of the spring are the same. As the particle diameter is smaller, the time required for deformation is shorter and thus the time when heat generated during the deformation is dissipated outside the deformation area is shorter, resulting in increasing the temperature in the deformation area. (See description and expression (8) on page 256 of "Kotal no Masatsu to Junkatsu (Friction and lubrication of solid)" by Bowden & Taber, translated by Norimune Soda, 4th ed., Maruzen. 1975. This literature describes that the contact time of colliding materials is in proportion to the square root of (mass M/grain radius r), i.e., $\sqrt{(M/r)}$. According to this description, since $\sqrt{(M/r)}$ is proportional to r, the contact time is eventually in proportion to r.)

It is considered that in the spring surface layer subjected to the fine particle projection according to the present invention, the heating due to collision and deformation and the strain age hardening by carbon atoms and nitrogen atoms have developed greater than the case of the 0.3 mm dia. particles. It is also considered that the cementite is deformed partly because the cementite has a property that deformation resistance decreases as the temperature rises. It should be noted that the cementite is deformed and partly disappears, facilitating its fragmentation, when the fine particle projection velocity is about 180 m/sec. Fragmentation of the cementite reduces the effect of blocking the movement of a dislocation generated by the deformation in the iron. The fragmentation is therefore considered to be a cause of the reduction of the surface residual stress as well as the increased projection velocity. It should be noted that, when the variation in the size of particles with respect to the mean diameter of projected microparticles used for the present invention becomes great and the percentage of larger-size particles increases, the effect of improving endurance decreases. In view of this, the maximum mean diameter should actually be less than 100 μm, preferably 80 μm or less.

As another effect of the fine particle projection according to the present invention, it has been found that deformation of the spring due to the fine particle projection can be reduced and, as a result, occurrence of a variation in the size of springs during mass production can be reduced. The reason for this effect is presumed to be that the layer influenced by the fine particle projection according to the present invention is comparatively thin, contributing to suppression of a large deformation of the springs and that the collision velocity during the fine particle projection is comparatively low according to the present invention, contributing to a smaller variation in the projection velocity compared with high-velocity projection (FIG. 6).

When the surface layer of the thus-treated high-carbon steel spring is observed with a transmission electron microscope, development of a very minute structure (subgrain) having a bending in a deformation band generated by deformation of the surface is recognized, as well as decoupling (frangmentation) of part of cementite precipitates with very small intervals between them and an increase of dislocation density in the iron. However, when fine particles were projected at an optimal projection velocity according to the present invention, cementite decoupling hardly occurred. No clear micro-structure (polygonal structure) due to recovery/recrystallization was observed. No supercooled structure such as martensite and bainite was recognized, either.

It is effective to provide the compression residual stress inside down to a considerably deep portion of the surface layer by multi-stage shot peening for springs having a comparatively large wire diameter or plate thickness, specifically a wire diameter of 1.5 to 2.0 mm or more for wire springs. This is broadly adopted for valve springs for internal combustion engines of automobiles. According to the present invention, also, as in (A) of the 4th embodiment, particles having a diameter of 0.2 to 0.9 mm are projected at a velocity of 40 to 90 m/sec for preventing fatigue breaking from a nonmetallic inclusion by providing the compression residual stress comparatively deep inside the spring. For springs having a wire diameter of 2.0 to 2.5 mm or more, generation of cracks from inside and a position near the surface can be prevented to some extent by projecting particles having a diameter of 0.2 to 0.4 mm after the projection of particles having a diameter of 0.5 to 0.9 mm (the 7th embodiment) to improve the residual stress in a layer comparatively near the surface. After such projection of particles having a diameter of 0.2 to 0.9 mm, the compression residual stress of the surface is still insufficient. The insufficient compression residual stress can be enhanced by the microparticle projection according to the present invention. For springs having a wire diameter or plate thickness smaller than the above value, improving fatigue strength by the projection of fine metal particles according to the present invention without nitriding is also included in the treatment method according to the present invention (the 3rd embodiment).

In order to overcome the disadvantage of the projection of comparatively large particles, according to the present invention (the 4th embodiment), hard fine metal particles having diameter between 10 to less than 100 μm, a mean diameter of all particles of 20 to 80 μm, a spherical or near spherical shape having no square portions, a specific gravity of 7.0 to 9.0, and its hardness of Hv 350 to 1100 are sufficiently projected at a velocity of 50 to 160 m/sec to form a strongly treated layer in uniform without generating a microcrack or a large recess harmful to fatigue strength in the surface layer, to provide a high compression residual stress.

The coverage of the above projection of particles having a diameter between 10 to less than 100 μm, preferably 10 to 80 μm is desirably 100% or more of the area of the target spring which requires improvement of endurance. The sufficient projection described above corresponds to this coverage.

The lower limit of the initial hardness of the particles having a diameter of 0.2 to 0.9 mm was set at Hv 350 for the following reasons: Particles having a lower hardness than that of the spring surface are repeatedly deformed by repeated collisions and gradually work-hardened, increasing the hardness. Part of energy at collision is used for deformation of the spring surface layer if the hardness of the particles is Hv 350 or more. In consideration of the above, Hv 350 was adopted as the lower limit.

As described above, it was found that good results were obtainable for non-nitrided springs having a surface hardness lower than that of the nitrided springs under conditions similar to those for the nitrided springs.

The initial hardness of projected particles as used herein refers to the hardness of new particles. The values of the hardness and the like recited in the embodiments are those of new particles. In the present invention, since particles to be projected are gradually worn and abraded over repeated use, particles smaller than new particles are actually used. It is therefore necessary that such particles are not changed to particles having sharp edges by breaking during the use. The following steps are included in the spring production process according to the present invention: low-temperature annealing for removing the residual stress at a temperature of about 250 to 500° C. for springs subjected to cold forming; polishing a seat face after coil spring formation, after annealing for removing the residual stress after the coil spring formation, after nitriding, or the like; low-temperature annealing by heating at a temperature of about 200 to 250° C. for improvement of creep resistance after microparticle projection or after projection of particles having a diameter of 0.2 to 0.9 mm as a pre-step of the microparticle projection; and warm or cold setting for the same purpose.

An effect of the projection of hard metal particles according to the present invention is to provide a high compression residual stress without reducing the ductility and toughness of the spring surface layer which may be caused by generation of a microcrack or excessive plastic working harmful to fatigue breaking, so that spread of a microcrack from a defective portion on the surface or in the surface layer which may cause fatigue breaking is prevented, to improve fatigue endurance. The projection of hard fine particles according to the present invention realizes work hardening due to metallographic work deformation in a substantially outermost surface layer without generating a defect harmful to fatigue in the spring surface layer, and as a result provides an extremely high compression residual stress. Instantaneous heating and high pressure generated by the fine particle projection causes strong deformation of $F\theta_3C$ in the spring steel and disappearance thereof by partial decomposition, generating C atoms in solid solution, which in turn facilitate dislocation fixation and dislocation multiplication. In the nitrided spring surface layer, also, nitrogen in solid solution causes dislocation fixation and multiplication via instantaneous deformation and heating during the fine particle projection as described above for C atoms. These especially facilitate size-reduction and work hardening of the cell structures of the spring surface layer. Such forms were clarified by several ten thousand magnification transmission electron microscope. It is considered that large work hardening in the surface layer improves the elastic limit of the surface layer and, as a result, contributes to improvement of the residual stress which falls within the elastic limit. The best effect can be obtained when the collision velocity against the spring during fine particle projection is 60 to 140 m/sec. If it is higher than this range, although an effect is obtained, the residual stress by processing is gradually reduced as the collision velocity increases especially for nitrided springs, and the material becomes brittle due to a microcrack and excessive plastic working, resulting in reduction of the effect of improving fatigue strength. If the velocity exceeds 190 m/sec, more strictly 170 m/sec for nitrided springs, such a defect becomes more significant. For non-nitrided springs, if the velocity exceeds 160 m/sec although an effect is obtained, it is far from the optimal conditions. If the collision velocity during projection is less than 60 m/sec or 50 m/sec, the depth of the surface portion of the spring which can be processed by the collision becomes small and the residual stress decreases. As a result, although the effect of improving fatigue strength is obtained, it is clearly inferior to the optimal conditions.

BRIEF DISCRIPTION OF THE DRAWINGS

Figure 5:
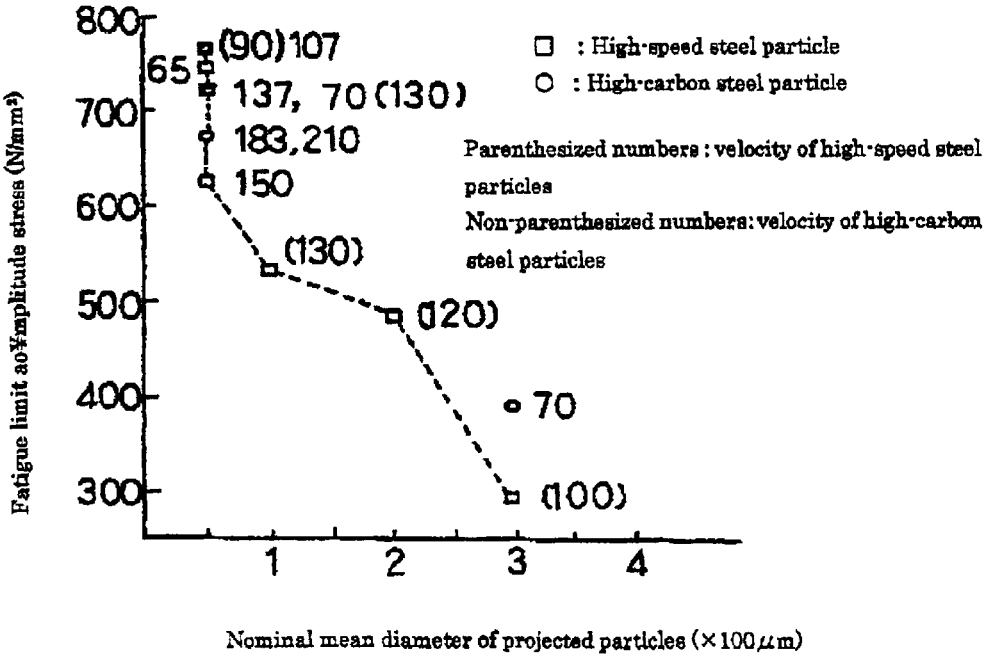

FIG. 5 shows the investigation results of the influence of the projection of hard metal particles on a spring steel thin-plate spring, showing the relationship between the mean diameters of projected particles made of high-carbon steel and high-speed steel and the fatigue limit amplitude stress (mean stress; fixed at 786 N/mm$^2$) after particle projection. The numbers in this figure represent collision velocities in m/sec.

Figure 4:
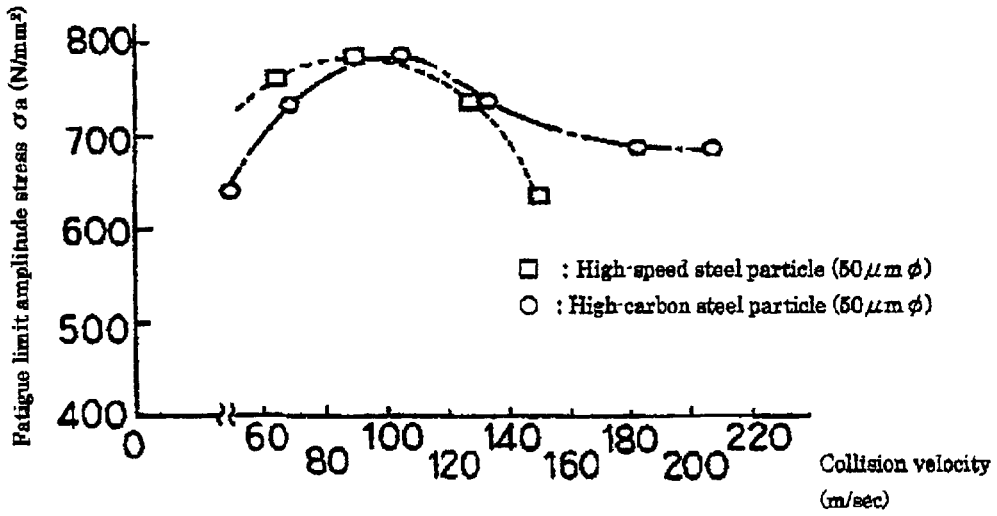
FIG. 4 is a view showing the effect of the collision velocity of the projection of the two types of steel particles having a nominal diameter of 50 $\mu$m against a spring on the fatigue limit amplitude stress of the spring after the projection. This figure was obtained by extracting part of the data of FIG. 5 and rearranging the data.
Figure 6:
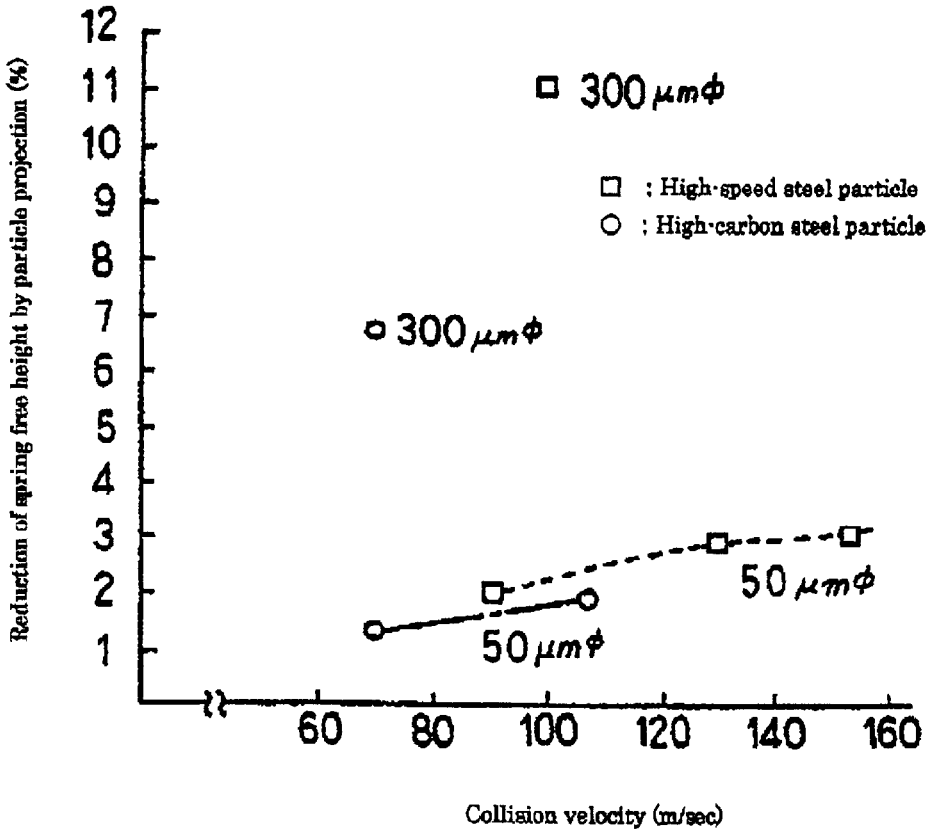

FIG. 6 shows the measurement results of the reduction in the height of a thin-sheet spring due to projection of hard metal particles. This figure was derived from the measurement in the same test that was performed for the data of FIGS. 4 and 5. The numbers accompanying respective plot points represent nominal particle diameters.

Figure 7:
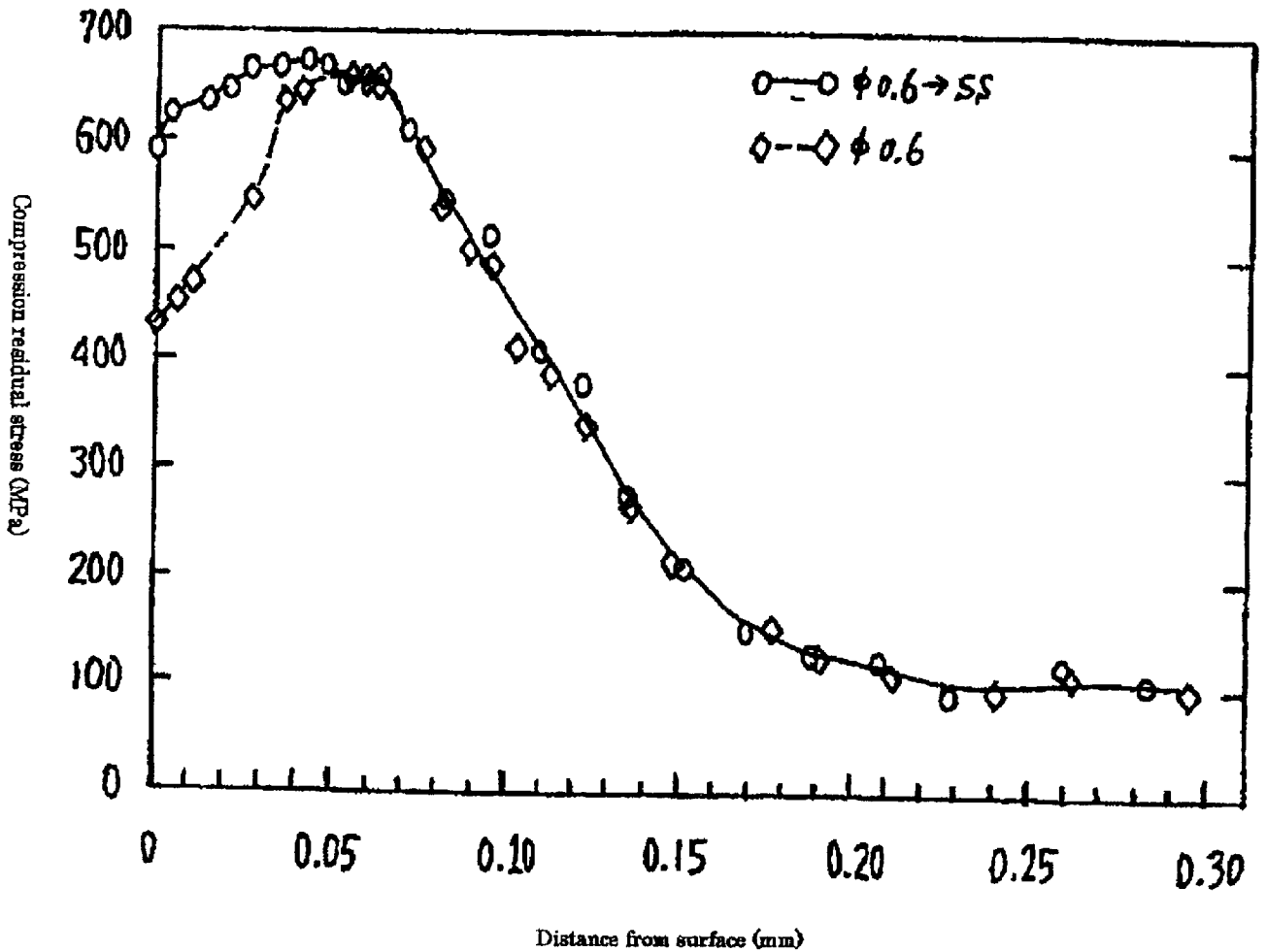

FIG. 7 shows iron matrix residual stress distribution curves obtained by X-ray method of the surface portion of a valve spring made of 4.0 mm dia. piano wire.

BEST MODE FOR CARRYING OUT THE INVENTION

Hereinbelow, embodiments of the present invention will be described.

(Embodiment A)

Conventionally, the following process has been employed for improving the durability, especially the fatigue resistance strength, of valve springs, crutch springs, and the like by nitriding.

Alloy steel oil tempered wires for springs (hereafter, referred to as OT wires)→forming springs (cold coiling) →annealing for removing a residual stress→polishing a seat face→descaling the surface→nitriding→shot peening→low-temperature annealing As the shot-peening after the nitriding, normally, steel balls having a grain diameter of about 0.5 to 0.9 mm and a hardness of Hv 500 to 800 or a number of hard metal particles such as cut wires are projected in the case of one-stage shot. In the case of two-stage shot, first a number of steel balls having a particle diameter of about 0.5 to 0.9 mm and then a number of metal particles having a grain diameter of about 0.2 to 0.4 mm are projected.

According to the present invention, a method of shot peening after nitriding is provided, where the following metal particles are projected at a velocity of 50 to 190 mm/sec. after the first-stage projection or after the second-stage projection subsequent to the first-stage projection. The metal particles have a mean diameter of all particles in the range between 20 $\mu$m and 80 $\mu$m inclusive, a mean diameter of each particle in the range between 10 $\mu$m inclusive and less than 100 $\mu$m, a spherical or near spherical shape having no square portions, a specific gravity of 7.0 to 9.0, and hardness which is in the range between Hv 600 and Hv 1100 inclusive and equal to or less than the hardness of the spring surface after nitriding or carbonitriding. By this projection, work hardening of the spring surface layer and prevention of generation of a microcrack are effectively obtained, and a high residual stress and hardness are provided for the outermost surface layer.

After the above steps, low-temperature annealing is performed to ensure dislocation pinning in the layer influenced by the shot peening (150 to 200 $\mu$m from the surface layer). By this annealing, a spring having markedly good fatigue resistance and creep resistance which would not have been realized by only conventional methods was obtained.

Examples of methods of descaling before nitriding include pickling, electropolishing, and metal particle projection. According to the present invention, a descaling method before nitriding is defined by the 2nd embodiment. This method is intended to obtain a high fatigue resistance after nitriding by projection of fine particles made of iron or the like.

The manufacture and performance of a spring in Embodiment A are as follows.

The high-performance spring corresponding to the 8th embodiment can be produced by the method defined by the 2nd embodiment, i.e., descaling before nitriding, followed by nitriding and subsequent particle projections.

A 3.2 mm dia. high.-trength oil tempered wire for valve spring containing C: 0.59%, Si: 1.90%, Mn: 0.84%, NI:0.27%, Cr:0.96%, and V:0.09% (unit: all mass percent) (material recited (2) in the 8th embodiment) was subjected to cold coiling, tempering for removing a stress at 420° C., and polishing a seat face. Then, the spring was subjected to descaling, where particles having a mean diameter of all particles of 37 μm a mean diameter of each particle of 75 to 10 μm, a shape having no square portions with a maximum/minimum diameter ratio of each particle of 1.2 or less, a specific gravity of 7.5, and a hardness of Hv 865 were projected at a velocity of 107 m/sec, followed by nitriding, to obtain a hardness of Hv 910 at a surface layer (a depth of 3 to 5 μm). Thereafter, round cut wires having a diameter of 0.6 mm and a hardness of Hv 550 were sufficiently projected at a velocity of 70 m/sec to provide the compression residue stress comparatively deep inside the spring. The hardness of the surface layer at this time was Hv 930. Subsequently, high-carbon steel particles having a mean diameter of all particles of 37 μm, a mean diameter of the largest particle of 75 μm or less, a mean diameter of the smallest particle of about 10 μm, a substantially spherical shape having no square portions with a major/minor diameter ratio of 1.2 or less, a specific gravity of 7.6, and a mean hardness of Hv 865 were projected sufficiently at a mean velocity of 107 m/sec. Low-temperature annealing was then performed at 220° C. The surface hardness at this time was Hv 975.

The compression residual stress in the spring outermost surface layer at the above was 2010 MPa. The hardnesses at depths of 0.2 mm and 0.5 mm from the surface of the spring were Hv 570 and Hv 545, respectively. The sizes of non-metallic inclusions and carbonitrides in the steel were 15 μm or less and less than 10 μm, respectively. The hardness of the outermost surface of the nitrided spring before the projection was Hv 910, the hardness of the projected 0.6 mm dia. carbon steel particles was Hv 550, the initial mean hardness of the fine high-carbon steel particles was Hv 865, and the mean hardness of used fine high-carbon steel particles was Hv 960. The resultant spring was subjected to a fatigue test varying an amplitude stress with a mean stress of 686 MPa at a velocity of 1000 times/min. under a constant amplitude stress. As a result, the fatigue limit was±677 MPa or more in amplitude stress at $5\times10^7$ times, and no breaking was exhibited in any of n=6 spring samples. Such a spring corresponds to the 8th embodiment, and the above production method corresponds to the 1st and 2nd embodiments.

Springs were also produced in the following manner. As the descaling, first, cut wires having a diameter of 0.6 mm and a hardness of Hv 550 were projected against springs at a velocity of 70 m/sec. Then, high-carbon steel particles having a mean diameter of all particles of 37 μm were projected at a velocity of 107 m/sec. The nitriding and subsequent steps were the same as those described above for the spring of Embodiment A. As a result, springs having substantially the same fatigue resistance were obtained. In this case, when projection of only the 0.6 mm dia. cut wires having a hardness of Hv 550 was performed as the descaling, the fatigue limit at $N=5\times10^7$ times was 686 MPa±647 Mpa even when the twostage projection was performed after the nitriding. The fatigue strength of a coil spring for valve spring can be expressed by the mean stress τm and the amplitude stress±τa if the number N of stress repetition times is fixed to a constant value. In this embodiment, N is fixed to $5\times10^7$ times. In the prior art technique, when τm=686 MPa, a value of about 610 to 620 MPa was attained as τa. Conventionally, however, such a high fatigue strength as τa≧677 MPa at τm=686 MPa has not been attained. It is conventionally known that for springs having the same quality and shape, as the mean stress τm increases, the stress amplitude τa of the fatigue limit decreases. It has been recognized that with an increase of τm by x MPa, τa of the fatigue limit decreases proximately by x/5. Therefore, the fatigue limit τm±τa can be represented by (constant 1−x)±(constant 2 +x5). When constant 1 is 800 MPa, the fatigue limit can be represented by (800−x)±(constant 2 +x/5). When the above fatigue 686 MPa±647 MPa is substituted into this expression, constant 2 is 624.2 MPa. Thus, in the present invention, a spring having a fatigue limit which satisfies expression (I) is presented in the 8th embodiment.

$$\text{When } \tau m=800-x, \tau a \geqq 620+x/5 \quad (1)$$

Where, the unit is all MPa and x denotes a variable in the range of 0 to 150 inclusive.

The springs descaled by the projection of 0.6 mm dia. iron-based particles before nitriding managed to satisfy expression (I), but with high stress repetition of a mean stress of 686 Mpa and an amplitude stress of±677 Mpa, inter-wire contact occurred at spring ends sporadically generating fatigue breaking. When the SS treatment according to the present invention is sufficiently performed subsequent to the projection of the 0.6 mm dia. particles as descaling, such fatigue breaking at an inter-wire contact portion can be improved. Thus, such two-stage shot descaling including the SS treatment is also included in the present invention.

Reference Springs (1) and (2) in Embodiment A

The above spring in which the second-stage microparticle projection was omitted, i.e., Reference spring (1), exhibited a fatigue limit amplitude stress of±510 Mpa with a mean stress of 686 MPa. This does not satisfy the fatigue strength according to the 8th embodiment. Additionally, Reference spring (2) was produced, in which the second-stage projection was changed to projection of steel particles having a mean diameter of all particles of about 72 μm, a mean diameter of the largest particle of about 200 μm, and a mean diameter of the smallest particle of about 7 μm under an air pressure of 0.5 MPa (the collision velocity of particles having a mean diameter of 72 μm is about 130 m/sec.). The mean stress of the fatigue limit stress of this spring was the same as that of the spring of Embodiment A according to the present invention, and the amplitude stress was±530 Mpa. Although some effect is recognized, this does not satisfy the 8th embodiment.

In the above experiment, after nitriding, the spring was subjected to projection of steel particles having a diameter of 0.6 mm and a hardness of Hv 550 before the SS treatment. However, this pre-projection is little advantageous for a work having a wire diameter or plate thickness of 1.5 to 2 mm. Rather, it is more advantageous to perform the SS treatment immediately after the nitriding in the aspects of performance such as fatigue resistance and cost. This is therefore substantially included in the present invention.

(Embodiment B)

This embodiment according to the present invention is a method for processing a non-nitrided spring. According to this method, a number of hard metal particles having a mean diameter in the range between 10 μm inclusive and less than 100 μm, a specific gravity of 7.0 to 9.0, and a hardness of Hv 350 to 1100 are projected so as to keep the surface roughness as small as possible, form a strongly deformed layer comparatively in uniform on a substantially outermost surface layer without generating a local excessive deformation (also referred to as a local shear deformation band or an adiabatic deformation band), and provide a residual stress as high as possible, so that fatigue breaking from the surface layer of the spring can be prevented without the necessity of nitriding.

Hard metal particles having a hardness of Hv 350 to 1100, a specific gravity of 7.0 to 9.0, and a mean diameter in the range between 10 μm inclusive and less than 100 μm, desirably 10 to 80 μm are projected at a velocity in the range between 50 m/sec. and 160 m/sec. inclusive, desirably 60 m/sec. to 140 m/sec., so that a microcrack and a non-uniform shear deformation band harmful to the durability is not generated near the surface layer, the compression residual stress in substantially outermost surface layer is increased, and fatigue breaking of the spring from the surface layer is prevented. By this processing, the fatigue strength and endurance of small springs and various thin-sheet springs made of small diameter piano wires and small diameter oil tempered wires.

According to the present invention, the influence of the projection velocity was investigated and studied in detail, so as to obtain higher endurance. That is, fine particles are projected at a velocity V≦160 m/sec., desirably 60 m/sec.≦V≦140 m/sec., so as not to exceed the A3 transformation point unlike Japanese patent Publication for Opposition No. 2-17607, "Surface processing heat treatment method for metal work" defining the microparticle projection velocity v as 100 m/sec or more, and so as not to cause excessive deformation of the surface layer by projecting at a velocity V>160 m/sec, so that the resultant instantaneous temperature rise is controlled to be lower than the point at which recovery/recrystallization occurs and excessive deformation of the surface layer is prevented. In this way, higher durability is obtained.

Figure 1:
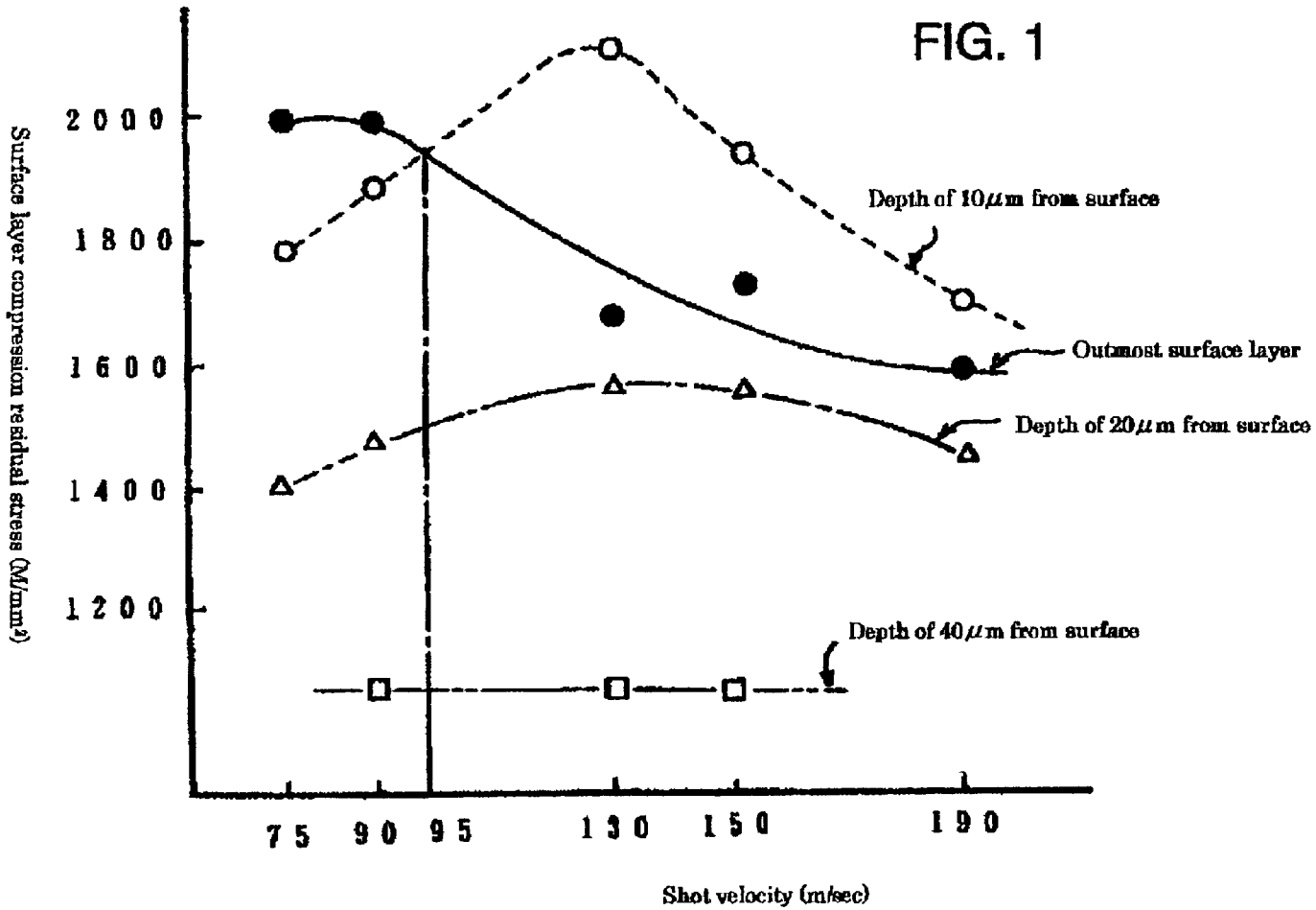
FIG. 1 shows curves representing the relationship between the compression residual stress at the surface of a high tensile spring and the particle projection velocity, when 0.6 mm dia, steel particles and then fine steel particles (mean diameter of 63 $\mu$m for new particles) are projected after nitriding.
Figure 2:
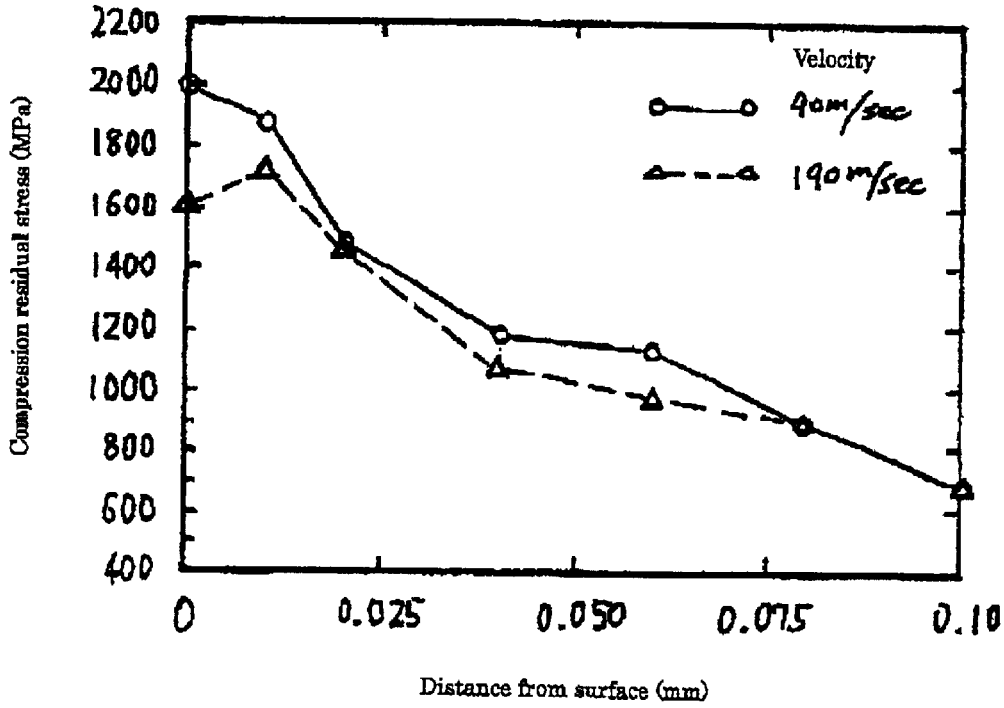
FIG. 2 shows curves of the compression residual stress obtained when high-speed steel fine particles having a mean diameter of 63 $\mu$m are projected against a nitrided spring after the projection of 0.6 mm dia. particles, as in FIG. 1, at projection velocities of 90 m/sec. and 190 m/sec.
Figure 3:
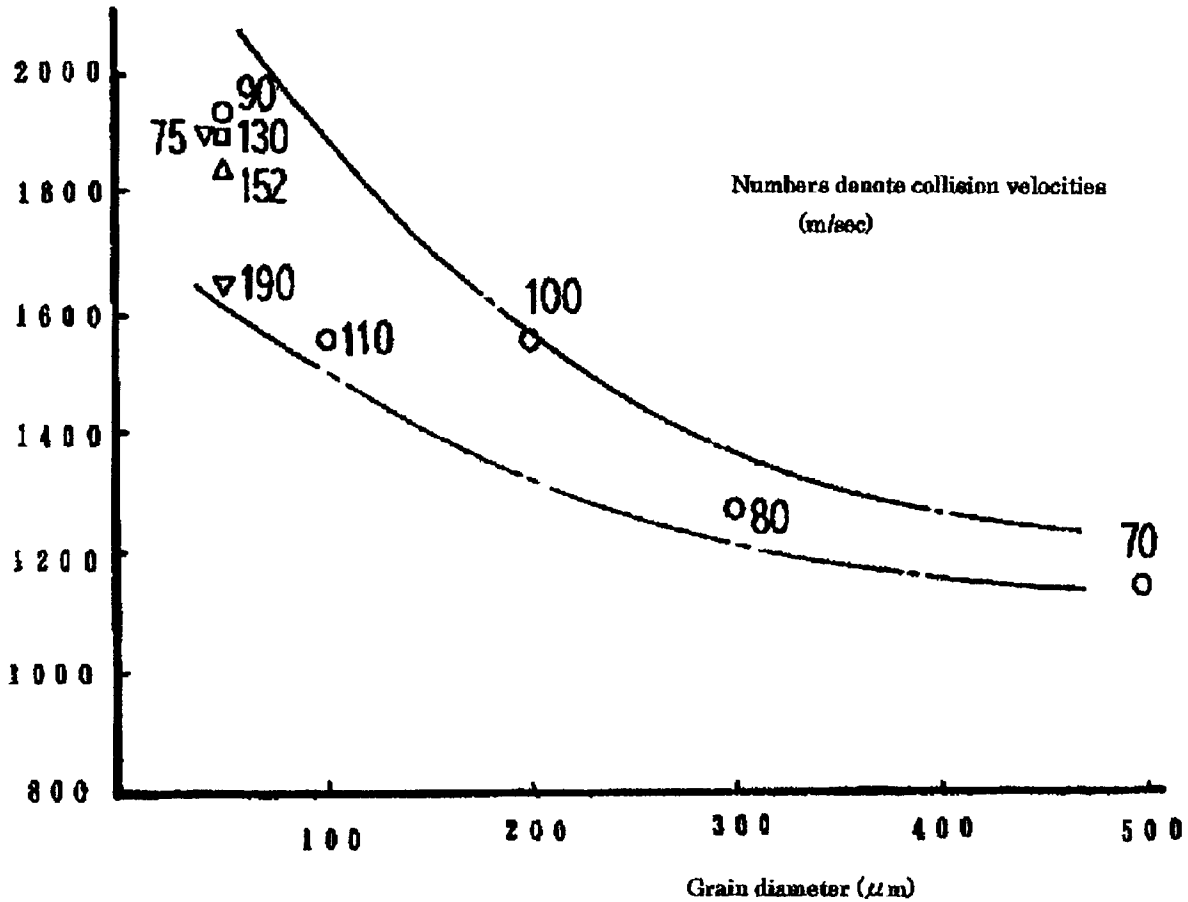
FIG. 3 shows curves representing the relationship between the compression residual stress obtained by the second-stage particle projection against the nitrided high-strength spring already subjected to the projection of 0.6 mm dia. particles, as in FIG. 1, and the diameter of the projected particles.

As sample springs, spring steel containing C: 0.55%, Si: 1.47, and the other alloy elements having a section of a plate thickness of 0.97 mm and a plate width of 5.1 mm and a hardness of Hv 537 to 589 subjected to patenting, wiredrawing, and cold rolling was used. The spring processing steps were in the order of forming springs→annealing for removing a stress→projecting fine particles→low temperature annealing (230° C.). The step of projecting fine particles was performed using (I) fine carbon steel particles having a mean diameter of all particles of 37 μm (new particles), a hardness of Hv 865, and a specific gravity of 7.6 and (2) fine high-speed steel particles having a mean diameter of all particles of 63 μm (new particles), a hardness of Hv 860, and a specific gravity of 8.2. These fine particles were sufficiently projected at various velocities. Then, a fatigue test was performed for the resultant springs, to obtain the relationship between the fine particle projection velocity and the fatigue strength. The results are shown in FIG. 3. The fatigue limit stress at this time was a mean stress of 785 MPa and an amplitude stress of no breaking at $10^7$ times of repetition. As a result, it was found that for both the carbon steel particles and the high-speed steel particles, the best effect of improving the fatigue strength was obtained at a collision velocity of 60 to 140 m/sec. As for the projection of (2) high-speed steel particles, it is considered that the fatigue limit amplitude stress exceeds 700 MPa when the collision velocity V is in the range of 50 to 140 m/sec. As for the projection of (1) high-carbon steel particles, it is considered that the fatigue limit amplitude stress exceeds 700 MPa when the collision velocity V is in the range of 60 to 160 m/sec. Therefore, a very good improving effect is recognized.

As comparative examples of the present invention, a spring without shot peening had a fatigue limit amplitude stress of 440 MPa exhibiting a low fatigue limit. A spring subjected to sufficient projection of 0.3 mm dia. steel shots at a velocity V=100 m/sec. had a fatigue limit amplitude stress of±300 MPa, exhibiting no effect of particle projection (this sample was produced in the same manner as that for Embodiment B except that 0.3 mm dia steel shots were projected in place of microparticles.

(Example 3)

For non-nitrided high-strength springs having a comparatively large section, e.g., a wire diameter of 2 mm or more, steel particles having a diameter of 0.2 to 0.9 mm are projected at a velocity of 40 to 90 m/sec. as a pre-treatment of the fine particle projection to provide a compression residual stress comparatively deep inside the springs. By this pre-treatment, while the compression residual stress reaches the maximum value at a depth of several tens of micrometers from the surface, it is low in the substantially outermost surface layer compared with the maximum value obtained inside the spring. This fails to,satisfactorily prevent fatigue fracture originating from near the surface of the spring. In order to improve this problem, hard metal particles having a diameter between 10 and less than 100 μm, more desirably 10 to 80 μm, a specific gravity of 7.0 to 9.0, and a hardness of Hv 350 to 1100 are projected at a velocity v of 50 to 160 m/sec., more desirably 60 to 140 m/sec., after the above projection of particles having a diameter of 0.2 to 0.9 mm.

Spring of Embodiment C

A high-strength oil temper wire for valve spring having a diameter of 3.2 mm, a tensile strength of 2070 MPa which is higher than JIS SWOSC-V, and a hardness of the surface portion of about Hv 620 (chemical composition is C: 0.61%, Si: 1.46%, Mn: 0.70%, Ni: 0.25%, Cr0.85%, and V: 0.06%; unit is all mass percent; this material corresponds to steel type (2) in the 8th embodiment) was formed into a coil spring by cold working. For removing a residual stress generated by the coiling, the resultant coil was subjected to low-temperature annealing at 400° C. for 20 minutes, seat-face polishing, projection of steel particles having a diameter of 0.6 mm, a specific gravity of about 7.8, and a hardness of Hv 550 at a velocity of 70 m/sec. Subsequently, it was subjected to sufficient projection of iron-based particles having a nominal diameter of 50 μm, a mean diameter of all new particles of 37 μm as actually measured, a shape having no square portions with a maximum/minimum diameter ratio of each particle of 1.2 or less, a specific gravity of about 7.5, a mean hardness of Hv 865, and a mean diameter of each particle distributing within the range of 10 to 75 μm (measured for n=60) at a collision velocity of 107 m/sec. The resultant spring was subjected to low-temperature annealing at 220° C. for dislocation pinning, and then cold setting for finishing. The thus-produced spring of Embodiment C was examined by X-ray method and found that the compression residual stress was 1350 MPa on the outermost surface of the iron matrix and decreased as the measured position was deeper from the surface. The hardness was Hv 690 at the substantially outermost surface layer, and Hv 600 to 580 at the depth of 0.2 mm to 0.5 mm from the surface layer on the inner side of the spring. A fatigue test was performed for this spring and found that for n=10 test springs no breaking was found at $5\times10^7$ times of repetition and the fatigue limit mean stress was 588 MPa while the amplitude stress was±510 MPa. Assuming that the maximum mean stress loaded on this coil spring is 690 MPa and the mean stress is expressed as $\tau m=690-x$, the fatigue limit amplitude stress $\tau a$ can be expressed as $\tau a=489.6+x/5$ from the relationship between $\tau m$ and $\tau a$ described in Embodiment A. This expression is however a mathematization of the results of only one test described above. In consideration of the tensile strength of a steel wire, the type of the steel, the wire diameter, and the like, the following was obtained.

When mean stress $\tau m=690-x$,
fatigue limit amplitude stress $$\tau a=\pm(470+x/5) \quad (2)$$

From the above, it is found that the spring of Embodiment C satisfies expression (2) in the 9th and 10th embodiments. The spring of the 9th embodiment according to the present invention tends to have a residual stress of 1200 MPa to 1600 MPa in the near surface layer (the outermost surface layer). Therefore the range for the spring according to the present invention is defined as 1100 to 1700 MPa.

Comparative Springs (3) and (4) in Embodiment C

Comparative spring (3) was produced using an oil tempered wire of the same lot as the spring of Embodiment C described above in the same process as that described above except that the projection of iron-based particles having a nominal diameter of 50 μm was omitted. The maximum compression residual stress in the surface layer of the resultant spring was at a depth of about 40 μm from the surface, and the value was about 820 MPa. The compression residual stress near the surface was 630 MPa which does not satisfy the requirement of the 9th embodiment. As a result of a fatigue test performed on this spring, the mean stress of 588 MPa and the amplitude stress of±440 MPa were obtained as the fatigue limit at $5\times10^7$ times of repetition, which is lower than the fatigue limit recited in the 10th embodiment. Further, comparative spring (4) was produced as follows. As the second-stage projection, high-carbon steel particles having a nominal diameter of 100 μm, a mean diameter of all particles of 97 μm as actually measured, a mean diameter of the largest particle of 130 μm as actually measured, and a mean diameter of the smallest particle of 35 μm as actually measured, and a maximum/minimum diameter ratio of each diameter of 1.2 or less were projected at a velocity of about 85 m/sec. Thereafter, as in the spring of Embodiment C, the resultant spring was subjected to low-temperature annealing at 220° C., and then cold setting for finishing. As the results of a fatigue test at $5\times10^7$ times of repetition the amplitude stress of±461 MPa with the mean stress of 588 MPa, which does not satisfy the requirement of the 10th embodiment.

The relationship between the hardness of the spring surface before projection of particles having a diameter in the range between 10 μm and less than 100 μm and the hardness of projected particles is as follows. When the spring is not nitrided, the spring surface is lower in the hardness than a nitrided spring and thus higher in the ductility. Accordingly, a microcrack and the like are less easily generated even when steel particles having a hardness higher than that of the spring surface are projected as far as the projection velocity is 160 m/sec or less. Meanwhile, the effect of improving the surface layer is observed even if the hardness of projected particles is lower than that of the spring surface. In particular, in the case where the hardness of the spring to be processed is as high as Hv 550 to 600 or more and the projection is performed at a comparatively high velocity of 100 to 140 m/sec, or more, if fine particles having a hardness equal to or less than that of the material to be processed are projected, the unevenness of the surface is reduced and further a high residual stress is obtained comparatively deep inside. If the hardness of projected particles is low, the projected particles themselves, not the spring to be processed, are markedly work-hardened by repeated projections. However, if the hardness of new particles is less than Hv 350, the efficiency of obtaining the effect of improving the surface layer of the spring to be processed decreases. Accordingly, in the 3rd, 4th and 5th embodiments, the lower limit of the hardness was set at Hv 350. Fine particles made of carbon steel and alloy steel are economical since they are available at comparatively low cost. The hardness of such fine particles is Hv 1100 or less. In consideration of the economy and for prevention of an increase of surface roughness and generation of a microcrack in the surface layer which are harmful to endurance, the upper limit of the hardness of new fine particles was set at Hv 1100.

(Embodiment D)

Hereinbelow, a spring corresponding to the 11th embodiment will be described, which is made of a steel wire mainly composed of fine pearlite subjected to wiredrawing for strengthening and produced without nitriding by performing normal shot peening with comparatively large shots and thereafter projection of fine particles having a nominal diameter of 50 μm. A valve spring for internal combustion engine for automobile was produced as a trial using a piano wire having a diameter of 4.0 mm, a tensile strength $\sigma B=1,735$ MPa, a mean hardness of Hv about 450. The piano wire was formed into a spring by cold coiling, subjected to annealing at 350° C. for 15 minutes for stress removal, removal of a tensile residual stress on the surface of the inner portion of the coil, and polishing of a seat face. Cut wires having a diameter of 0.6 mm and a hardness of Hv 550 were sufficiently projected and then low-temperature annealing was performed at 220° C. Subsequently, high-carbon steel particles having a mean diameter of all particles of 37 μm, a mean diameter of the largest particle of about 75 μm a specific gravity of about 7.6, a hardness of Hv 865, a shape having no square portions with a maximum/minimum diameter ratio of each particle of 1.2 or less were sufficiently projected at a velocity of 107 m/sec. This was followed by low-temperature annealing at 220° C. and cold setting. The compression residual stress of the outermost surface layer of this spring was 590 MPa (FIG. 7).

Comparative spring (5) was produced using the same material and process as those described above for the spring of Embodiment D except that the projection of 50 μm dia. microparticles was omitted. The compression residual stress on the outermost surface layer was 430 MPa (FIG. 7) which does not satisfy the requirement of the 11th embodiment, i.e., 550 Mpa. Also, Comparative spring (6) was produced by projecting particles having a nominal diameter of 100 μm under the same conditions as those of the second-stage projection of Comparative spring (2), in place of the second-stage projection for the above spring according to the present invention.

The thus-produced valve spring of Embodiment D according to the present invention and comparative springs were subjected to fatigue test. The test was performed at a speed of 1000 cycles/min using n=15 springs for each stress level. As a result, the spring of Embodiment D according to the present invention was clearly superior in the improving effect to the comparative springs as described below. The former satisfied expression (3) in the 11th embodiment while the comparative examples (5) and (6) did not satisfy the expression.

Fatigue strength

Spring of Embodiment D fatigue limit $\tau a \geqq 461$ Mpa according to the invention Comparative spring (5) fatigue limit $\tau a=373$ Mpa Comparative spring (6) fatigue limit $\tau a=402$ MPa (Mean stress $\tau m=588$ MPa, $5\times10^7$ times of repetition for all cases)

Assuming that the maximum mean stress loaded on the coil spring is 690 MPa and considering the relationship between the mean stress and the amplitude stress described above in relation to expressions (1) and (2), for the mean stress $\tau m=690-x$, the fatigue limit amplitude stress $\tau a$ of the spring of Embodiment D can be expressed as $\tau a \geqq 440.6+x/5$. In consideration of the wire diameter, the tensile strength of the wire, the type of the steel, and the like, the spring which satisfies expression (3) below is defined as the spring according to the present invention, and the compression residual stress in the near surface layer is set at 550 MPa or more (the 11th embodiment).

When mean stress $\tau m=690-x$, fatigue limit amplitude stress at $5\times10^7$ times of repetition $$\tau a \geqq 422+x/5 \quad (3)$$

where x: 0 to 140.

From FIG. 7 showing residual stress distributions of the spring of this embodiment and the comparative spring (Comparative spring (5) only), it is observed that the residual stress in the surface layer from the outermost surface to the depth of 50 $\mu$m was greatly improved by the SS treatment. The surface roughness Rmax of these springs was 13.2 $\mu$m in the case of only the projection of 0.6 mm dia. particles, and 9.2 $\mu$m in the case of the projection of particles having a mean diameter of all particles of 37 $\mu$m after the projection of 0.6 mm dia. particles according to the present invention.

In the above tests, when the stress loaded on the spring of Embodiment D during the fatigue test was large, the creep of the spring slightly increased. In order to prevent this generation of creep, a steel wire of a pearlite type subjected to cold wiredrawing with an addition of an element which increases creep resistance, such as silicon and/or chromium, may be used in place of the piano wire. Hot setting may also be employed for prevention of creep. The present invention includes these modifications.

(Embodiment E)

A valve spring was produced as a trial using a 3.2 mm dia. JIS SWOSC-V oil tempered wire for valve spring. The valve spring was subjected to the SS treatment without nitriding. The valve spring was produced in the following process: spring coiling; tempering at 400° C. for 20 minutes; projection of iron-based round cut wires having a diameter of 0.6 mm at a velocity of 70 m/sec.; SS treatment with high-carbon steel microparticles (velocity: 107 m/sec., mean diameter of all particles: 40 $\mu$m, mean diameter of the largest particle: 75 $\mu$m); low-temperature annealing at 220° C. for 20 minutes; and finally cold setting. The compression residual stress in the near surface layer was 1010 MPa. The spring was subjected to a fatigue test. As a result, the fatigue limit amplitude stress was 466 MPa with the mean stress $\tau m=588$ MPa at $N=5\times10^7$ times of repetition. The amplitude stress $\tau a$ can be expressed as $\tau a=445.6+x/5$ when the mean stress is $690-x$. In consideration of a variation in the tensile strength of the SWOSC-V oil tempered wire, the wire diameter range, and the like, according to the present invention, the compression residual stress of the iron base in the near surface is set at 900 MPa or more, and the fatigue strength of the spring is defined as expression (4) below (the 11th embodiment).

When mean stress$\tau m=690-x$, repeat stress $\tau a$ at $5\times10^7$ times is:

$$\tau a \geqq 440+x/5 \quad (4)$$

All of expression (2) in the 10th embodiment, expression (3) in the 11th embodiment, and expression (4) in the 12th embodiment indicate that when the mean stress decreases by x MPa, the fatigue limit amplitude stress increases by (x/5) MPa. These expressions were induced in consideration of the results of the fatigue test for the trial springs produced using the steps and material recited in the respective embodiments as essentials. The residual stress in the outermost surface layer and the fatigue strength are superior to the conventional springs which are not subjected to stress-peening as described above. The fatigue strength and the residual stress can further be improved if the projection of fine particles according to the present invention is performed under the state of stress loading (stress-peening) as described above.

Thus, from the foregoing, the following are recognized.

(1) The method of improving the fatigue strength of a coil spring by nitriding is effective for a compressed coil spring such as a valve spring, but is disadvantageous in that cost is high. The present invention provides a surface treatment method and a spring capable of improving the endurance at comparatively low cost without the necessity of a large-scale facility as is required for nitriding.

(2) Considerably great endurance improvement is possible for a carbon steel spring for which endurance improvement by nitriding is substantially impossible, for example springs made of piano wire, hard drawn carbon steel wire, carbon steel oil tempered wire, and carbon steel thin sheet.

(3) For a thin-sheet spring on which a high tensile stress acts and a spring used under tensile strength, nitriding does not stabilize the fatigue strength be it in reverse spoils the fatigue strength.

According to the present invention, fine particles are projected in the spring surface portion most appropriately to allow for strong working of the spring efficiently. This drastically improves the durability of a spring used under tensile or bending stress, a tensile spring, and the like, contributing to reduction of weight and size of the spring.

(4) As the fine particle projection velocity according to the present invention decreases, the amount of deformation of a spring by the particle projection becomes smaller compared with the case of projection at an excessively high velocity, resulting in reducing the variation in the dimensions of the spring. This contributes to the stability of the quality of the spring.

What is claimed is:

1. A spring surface treatment method, comprising the steps of:

(A) nitriding a surface layer of a spring;

(B) projecting hard metal particles having hardness which is lower than the hardness of the nitrided outermost surface layer and is in the range of Hv 500 to 800 and diameters from 200 to 900 $\mu$m against the nitrided surface of the spring at a velocity from 40 m/sec. to 90 m/sec., so as to prevent generation of a microcrack in the surface layer by the projection and provide compression residual stress comparatively deep inside the springs; and (C) projecting a number of fine metal particles having a mean diameter of all particles of 80 $\mu$m or less, a mean diameter of each particle in the range between 10 $\mu$m and 80 $\mu$m inclusive, a spherical or near spherical shape having no square portions, specific gravity from 7.0 to 9.0, and hardness which falls in the range between Hv 600 and Hv 1100 inclusive and is equal to or less than the hardness of the outermost surface layer of the spring after nitriding or low-temperature carbonitriding at velocity from 50 to 190 m/sec., while controlling an instantaneous temperature rise limit of an iron matrix excluding the nitride compound layer of the nitrided spring surface layer due to collision to be low enough to cause work hardening in the spring surface layer but not to cause softening due to recovery/recrystallization, thereby effectively work hardening and preventing generation of any microcracks in the surface layer to provide a high compression residual stress and hardness.

2. A spring surface treatment method, comprising the steps of:

(A) projecting a number of metal particles having diameters between 10 μm inclusive and less than 100 μm, a mean diameter of all particles of 80 μm or less, a mean diameter of each particle of 10 to 80 μm, a spherical or near spherical shape having no square portions, a specific gravity of 7.0 to 9.0, and a hardness of Hv 350 to 900 against a surface of a spring before nitriding at a collision velocity in the range of 50 m/sec. and 160 m/sec. inclusive so that a temperature rise limit of the surface of the spring due to collision is controlled to be low enough to cause work hardening of an iron matrix of the spring but lower than the point at which recovery/recrystallization may occur so as to prevent generation of any microcracks;

(B) nitriding a surface portion of the spring after step (A);

(C) projecting hard metal particles having hardness which is lower than the hardness of the nitrided outermost surface layer and in the range of Hv 500 to 800, and a grain diameter of 200 to 900 μm against the nitrided surface of the spring at a velocity of 40 m/sec. to 90 m/sec., so as to prevent generation of any microcracks in the surface layer by the projection and provide compression residual stress comparatively deep inside each spring; and (D) projecting a number of metal microparticles having a mean diameter of all particles of 80 μm or less, a mean diameter of each particle in the range between 10 μm and 80 μm inclusive, a spherical or near spherical shape with no square portions, a specific gravity of 7.0 to 9.0, and a hardness which falls in the range between Hv 600 and Hv 1100 inclusive and is equal to or less than the hardness of the outermost surface layer of the spring after nitriding or low-temperature carbonitriding at the velocity of 50 to 190 m/sec., while controlling the instantaneous temperature rise limit of the iron matrix excluding nitride compound layer of the nitrided spring surface layer due to collision to be high enough to cause work hardening in the surface layer but lower than a point at which softening due to recovery/recrystallization may occur, thereby effectively causing work hardening and preventing generation of any microcracks in the surface layer to provide a high compression residual stress and hardness.

3. A surface treatment method, comprising the step of bombarding hard metal particles having hardness in the range between Hv 350 and 1100, specific gravity of 7.0 to 9.0, a mean diameter of all particles of 80 μm or less, a mean diameter of each particle in the range between 10 μm and 80 μm inclusive, and a spherical or near spherical shape with no square portions, on a surface of a spring with surface layer hardness of Hv 400 to 750, which hardness was obtained by one of low-temperature annealing for removal of macroscopic residual stress after cold forming, quenching and tempering after cold forming, and quenching and tempering after hot forming, at a collision velocity of 50 m/sec to 160 m/sec, while controlling the temperature rise limit of the spring surface layer due to collision to be low enough to cause work hardening in the spring surface layer but not to cause softening due to recovery/recrystallization and preventing generation of any microcracks in the surface layer which may deteriorate fatigue strength, thereby improving the hardness and compression residual stress of the surface layer which is 30 μm to 50 μm or less deep from the surface and resulting in improved endurance of the spring.

4. A spring surface treatment method for preventing generation of harmful microcracks in a surface layer of a spring which may deteriorate fatigue strength and for improving especially the hardness and compression residual stress of the surface layer which is 30 μm to 50 μm or less deep from the surface, to improve endurance of the spring, the method comprising the steps of:

(A) projecting hard metal particles having hardness of Hv 350 to 900 and a particle diameter of 200 to 900 μm against the surface of a formed and tempered spring having a surface layer with hardness of Hv 400 to 750 at a velocity of 40 m/sec to 90 m/sec so as to prevent generation of harmful microcracks in the surface layer and provide compression residual stress comparatively deep inside the spring; and (B) performing the surface treatment method according to claim 3 on the spring surface after step (A).

5. A spring surface treatment method according to claim 1 or 2, wherein the particles projected in step (C) of claim 1 or step (A) of claim 2 and the projection conditions of the particles are limited to the following:

hardness of projected particles: initial hardness being Hv 600 to 1100;

size of projected particles: initial mean diameter of each particle being 10 μm to 80 μm;

mean diameter of all particles: 65 μm or less;

specific gravity of projected particles: 7.0 to 9.0; and collision velocity against the spring: 60 m/sec. to 140 m/sec.

6. A spring surface treatment method according to claim 3 or 4, wherein the particles used to bombard the spring surface and the projection conditions of the particles are limited to the following:

hardness of projected particles: initial hardness being Hv 350 to 1100;

size of projected particles: initial mean diameter of each particle being 10 μm to 80 μm;

mean diameter of all particles: 65 μm or less;

specific gravity of projected particles: 7.0 to 9.0; and collision velocity against spring: 60 m/sec. to 140 m/sec.

7. A spring surface treatment method according to claim 1 or 4, wherein in the step (B) of claim 1 or in the step (A) of claim 4, the projection of the hard metal particles having a diameter of 0.2 to 0.9 mm is divided into first-stage projection of comparatively large particles having a diameter of 0.5 to 0.9 mm and second-stage projection of comparatively small particles having a diameter of 0.2 to 0.4 mm.

8. The spring surface treatment method of claim 2, wherein the metal particles in step (A) are iron-based particles.

9. The spring surface treatment method of claim 2, wherein the metal particles in step (A) have a mean diameter of all particles of 65 μm or less.

* * * * *